US009679529B2

(12) United States Patent
Morita

(10) Patent No.: US 9,679,529 B2
(45) Date of Patent: Jun. 13, 2017

(54) DRIVER HAVING CAPACITOR CIRCUIT INCLUDING FIRST TO NTH CAPACITORS PROVIDED BETWEEN FIRST TO NTH CAPACITOR DRIVING NODES AND A DATA VOLTAGE OUTPUT TERMINAL

(71) Applicant: SEIKO EPSON CORPORATION, Tokyo (JP)

(72) Inventor: Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/870,682

(22) Filed: Sep. 30, 2015

(65) Prior Publication Data

US 2016/0111058 A1 Apr. 21, 2016

(30) Foreign Application Priority Data

Oct. 15, 2014 (JP) ..... 2014-210366

(51) Int. Cl.
*G09G 3/36* (2006.01)

(52) U.S. Cl.
CPC ... *G09G 3/3688* (2013.01); *G09G 2300/0828* (2013.01); *G09G 2310/027* (2013.01); *G09G 2310/0264* (2013.01); *G09G 2320/02* (2013.01); *G09G 2330/028* (2013.01); *G09G 2330/04* (2013.01)

(58) Field of Classification Search
CPC ..... G09G 3/3685; G09G 3/3275
See application file for complete search history.

(56) References Cited

U.S. PATENT DOCUMENTS 5,332,997 A * 7/1994 Dingwall ..... G09G 3/2011 341/136
5,589,802 A * 12/1996 O'Shaughnessy ..... G01R 27/14 324/548
5,889,486 A * 3/1999 Opris ..... H03M 1/68 341/144
6,169,508 B1 * 1/2001 Edwards ..... G09G 3/2011 341/144
6,420,988 B1 7/2002 Azami et al.
6,486,812 B1 11/2002 Tanaka
6,819,305 B2 * 11/2004 Wicker ..... G09G 1/16 345/3.1
7,432,844 B2 * 10/2008 Mueck ..... H03M 1/0682 341/161
7,796,074 B2 * 9/2010 Walton ..... H03M 1/664 341/144
8,629,725 B2 * 1/2014 Scott ..... H03F 1/223 330/305

(Continued)

FOREIGN PATENT DOCUMENTS

JP 2000-341125 A 12/2000
JP 2001-156641 A 6/2001

*Primary Examiner* — Chad Dicke
(74) *Attorney, Agent, or Firm* — Oliff PLC

(57) ABSTRACT

In a display device including a driver that drives a load line of an electro-optical panel through capacitor charge redistribution, a data voltage will change in the case where an electro-optical panel-side capacitance changes, even when tone data is the same. Accordingly, by detecting a voltage at a data voltage output terminal, a connection state and outputs between the data voltage output terminal and the electro-optical panel can be detected.

9 Claims, 15 Drawing Sheets

(56) References Cited

U.S. PATENT DOCUMENTS

| | | | | |
|---|---|---|---|---|
| 2002/0033788 | A1* | 3/2002 | Kato | G09G 3/2011 345/89 |
| 2002/0186157 | A1* | 12/2002 | Tanaka | H03M 1/687 341/150 |
| 2004/0004566 | A1* | 1/2004 | Walton | H03M 1/664 341/150 |
| 2009/0109153 | A1* | 4/2009 | Nii | G09G 3/2011 345/87 |
| 2010/0188320 | A1* | 7/2010 | Min | G09G 3/3291 345/80 |
| 2012/0146722 | A1* | 6/2012 | Scott | H03F 1/223 330/192 |
| 2014/0184432 | A1* | 7/2014 | Huang | H03M 1/1057 341/110 |
| 2015/0326238 | A1* | 11/2015 | Umezaki | H03M 1/109 341/120 |

* cited by examiner $$VQ = 7.5V + 5V \times \frac{2^9 \times GD10 + 2^8 \times GD9 + \cdots + 2^0 \times GD1}{2^9 + 2^8 + \cdots + 2^0}$$

$$= 7.5V + 5V \times \frac{512 \times GD10 + 256 \times GD9 + \cdots + 1 \times GD1}{1023}$$

FE

FIG. 5A RESET
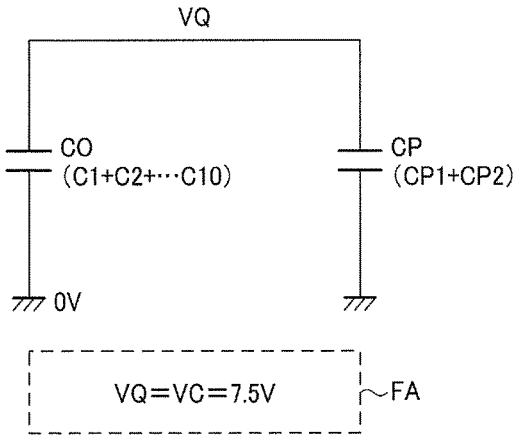
FIG. 5B MAXIMUM DATA VOLTAGE
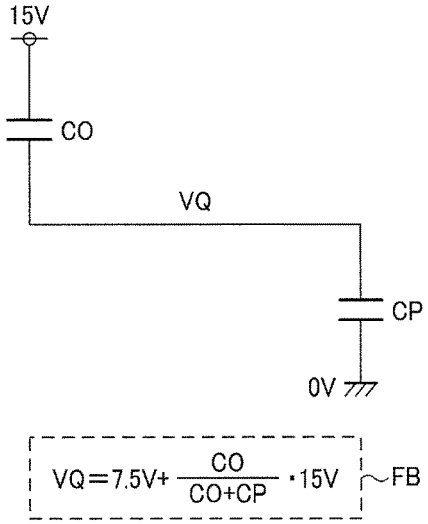
FIG. 5C
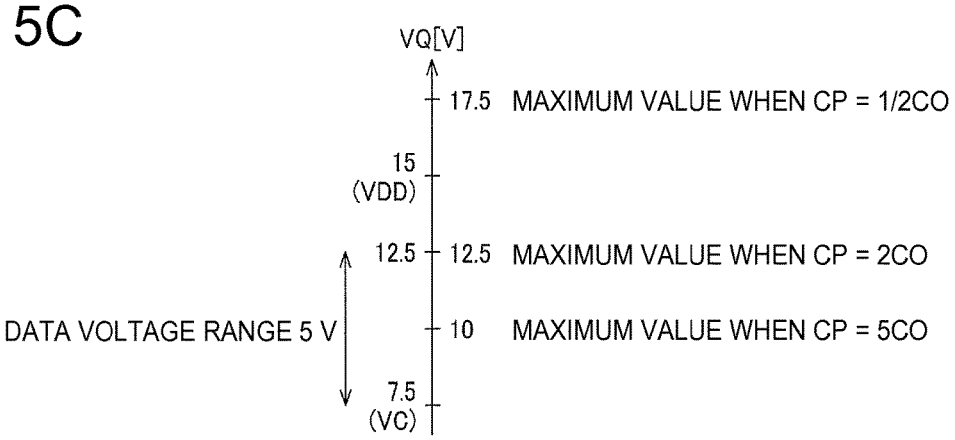

FIG. 12A (S8:NO)
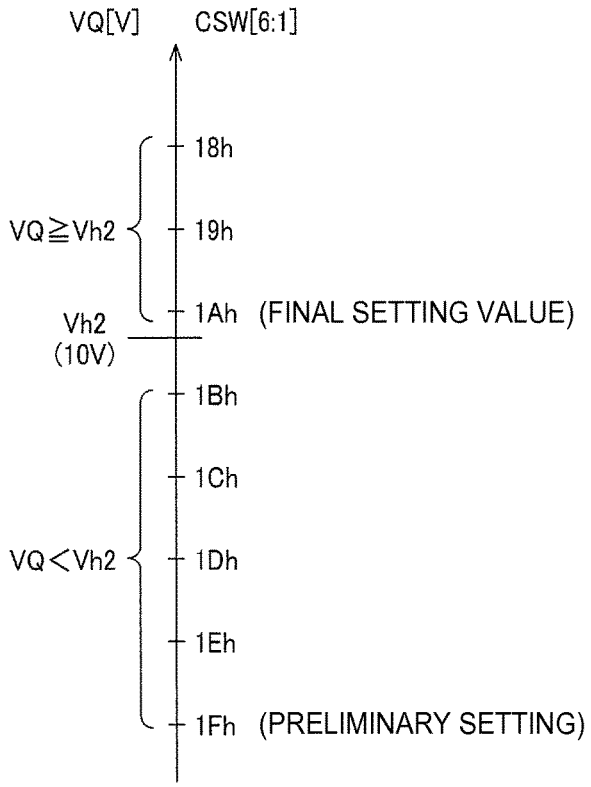
FIG. 12B (S8:YES)
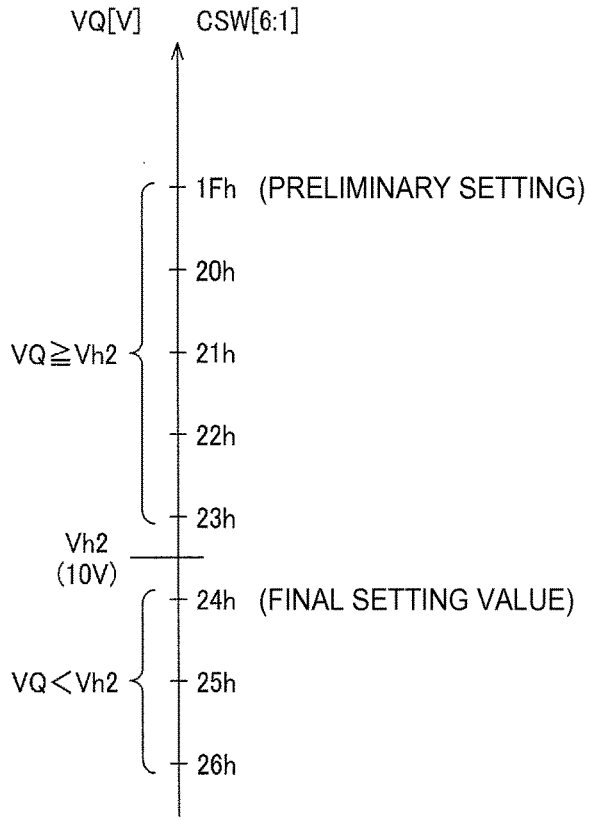

DRIVER HAVING CAPACITOR CIRCUIT INCLUDING FIRST TO NTH CAPACITORS PROVIDED BETWEEN FIRST TO NTH CAPACITOR DRIVING NODES AND A DATA VOLTAGE OUTPUT TERMINAL

BACKGROUND

1. Technical Field

The present invention relates to drivers, electronic devices, and the like.

2. Related Art

Display devices (liquid-crystal display devices, for example) are used in a variety of electronic devices, including projectors, information processing apparatuses, mobile information terminals, and the like. Increases in the resolutions of such display devices continue to progress, and as a result, the time a driver drives a single pixel is becoming shorter. For example, phase expansion driving is used as a method for driving an electro-optical panel (a liquid-crystal display panel, for example). According to this driving method, for example, eight source lines are driven at one time, and the process is repeated 160 times to drive 1,280 source lines. In the case where a WXGA (1,280×768 pixels) panel is to be driven, the stated 160 instances of driving (that is, the driving of a single horizontal scanning line) is thus repeated 768 times. Assuming a refresh rate of 60 Hz, a simple calculation shows that the driving time for a single pixel is approximately 135 nanoseconds. In actuality, there are periods where pixels are not driven (blanking intervals and the like, for example), and thus the driving time for a single pixel becomes even shorter, at approximately 70 nanoseconds.

Past drivers for driving such electro-optical panels have included D/A conversion circuits for converting tone data (image data) of each pixel into data voltages and amplifier circuits that drive the pixels with the data voltages. This is done in order for the amplifier circuits to carry out impedance conversion and supply charges for capacitance on the electro-optical panel side (parasitic capacitance of interconnects, pixel capacitance, and the like, for example). In other words, past drivers have been configured to supply required charges corresponding to the data voltages.

However, with the increases in resolutions of electro-optical panel as mentioned above, it is becoming difficult for the amplifier circuits to finish writing the data voltages within the required time. For example, in the above WXGA example, it is necessary for the writing for a single pixel to finish within 70 nanoseconds, and thus the write time becomes even shorter if an attempt to further increase the resolution is made. For the amplifier circuits to drive the pixels at high speeds, it is necessary to have a wide output range corresponding to the range of the data voltages, and to be able to supply the charges at a high speed at any voltage within that output range. Achieving both requires, for example, an increase in the bias voltage of the amplifier circuits, resulting in a further increase in power consumption in drivers as increases in resolution progress.

A method that drives an electro-optical panel through capacitor charge redistribution (called "capacitive driving" hereinafter) can be considered as a driving method for solving such problems. For example, JP-A-2000-341125 and JP-A-2001-156641 disclose techniques that use capacitor charge redistribution in D/A conversion. In a D/A conversion circuit, both driving-side capacitance and load-side capacitance are included in an IC, and charge redistribution occurs between those capacitances. For example, assume such a load-side capacitance of the D/A conversion circuit is replaced with the capacitance of the electro-optical panel external to the IC and used as a driver. In this case, charge redistribution occurs between the driver-side capacitance and the electro-optical panel-side capacitance.

However, the driver and the electro-optical panel are separate components, and thus it is not necessarily the case that the two will be connected securely in a manufacturing process and the like, for example. For example, component mounting defects (soldering defects), connectors of a flexible board coming loose, and the like are conceivable. Such cases result in the load-side capacitance not being connected (or not being fully connected). In the case of driving using an amplifier circuit, a charge will simply not be supplied from the amplifier circuit, and thus there is only a small chance that a voltage at an output terminal of the driver will exceed the breakdown voltage of the IC. However, in the case of capacitive driving, there is a problem that a charge supplied from the driving-side capacitance has nowhere to go, and it is therefore possible that the voltage at the output terminal of the driver will exceed the breakdown voltage of the IC and cause electrostatic breakdown.

SUMMARY

An advantage of some aspects of the invention is to provide a driver, an electronic device, and so on capable of detecting a connection defect in an electro-optical panel.

One aspect of the invention concerns a driver including a capacitor driving circuit that outputs first to nth capacitor driving voltages (where n is a natural number of 2 or more) corresponding to tone data to first to nth capacitor driving nodes, a capacitor circuit including first to nth capacitors provided between the first to nth capacitor driving nodes and a data voltage output terminal, and a detection circuit that carries out a first detection that detects a connection state between the data voltage output terminal and an electro-optical panel.

According to this aspect of the invention, the first to nth capacitor driving voltages corresponding to the tone data are outputted, the first to nth capacitors are driven by the first to nth capacitor driving voltages, and a data voltage corresponding to the tone data is outputted to the data voltage output terminal. In a driver that carries out such driving, the first detection that detects the connection state between the data voltage output terminal and the electro-optical panel is carried out. Through this, connection defects in the electro-optical panel can be detected. For example, the driver can be controlled in accordance with the detected connection state, and a data voltage that exceeds a breakdown voltage of the driver can be prevented from being outputted.

According to another aspect of the invention, the detection circuit may be a circuit that detects a voltage at the data voltage output terminal.

Accordingly, by detecting the voltage at the data voltage output terminal, the connection state between the data voltage output terminal and the electro-optical panel can be detected. In capacitive driving, in the case where an electro-optical panel-side capacitance has changed, the data voltage will change as well, even when the tone data is the same. Accordingly, by detecting the voltage at the data voltage output terminal, the connection state between the data voltage output terminal and the electro-optical panel can be detected.

According to another aspect of the invention, the driver may further include a control circuit that outputs first detection data to the capacitor driving circuit instead of the tone data in the case where the first detection is carried out, and the control circuit may determine the connection state based on a result of detecting a voltage, corresponding to the first detection data, at the data voltage output terminal.

By doing so, the first detection data is outputted to the capacitor driving circuit, which makes it possible to output a data voltage corresponding to the first detection data to the data voltage output terminal. This data voltage varies depending on the electro-optical panel-side capacitance, and a range of the data voltage is determined in accordance with an estimated range of the electro-optical panel-side capacitance. In other words, the connection state can be determined based on whether or not the detected voltage is within the data voltage range.

According to another aspect of the invention, an ith capacitor of the first to nth capacitors may have a capacitance value weighted by 2 to the power of (i−1) (where i is a natural number no greater than n), the capacitor driving circuit may output a first voltage level or a second voltage level that is higher than the first voltage level as each of the first to nth capacitor driving voltages, and the control circuit may output the first detection data that sequentially increases a total capacitance of the capacitors, among the first to nth capacitors, to which the second voltage level is supplied.

The voltage at the data voltage output terminal sequentially increases as a total capacitance of the capacitors to which the second voltage level is supplied increases. In the case where the electro-optical panel is incorrectly connected, the voltage at the data voltage output terminal will rise quickly even in the case where the first detection data is low, and thus by detecting that rise, the connection state of the electro-optical panel can be detected. Meanwhile, by starting from the capacitor to which the second voltage level is supplied having the lowest total capacitance, the voltage at the data voltage output terminal can be prevented from rising suddenly in the first detection, and the likelihood of electrostatic breakdown can be reduced.

According to another aspect of the invention, the driver may further include a register unit into which a result of detecting the connection state can be written, and from which the result of detecting the connection state can be read out by an external processing unit.

Accordingly, by the external processing unit reading out the result of detecting the connection state from the register unit, the driver can be controlled in accordance with that result of detecting the connection state. For example, it is possible for an external control unit to not cause the driver to carry out capacitive driving in the case where the read-out flag is a flag indicating a connection error.

According to another aspect of the invention, the driver may further include a variable capacitance circuit provided between the data voltage output terminal and a reference voltage node; and a capacitance of the variable capacitance circuit may be set so that a capacitance obtained by adding a capacitance of the variable capacitance circuit and an electro-optical panel-side capacitance is in a prescribed capacitance ratio relationship with a capacitance of the capacitor circuit.

Accordingly, even if the electro-optical panel-side capacitance is different, the prescribed capacitance ratio relationship can be realized by adjusting the capacitance of the variable capacitance circuit in accordance therewith, and a desired data voltage range that corresponds to that capacitance ratio relationship can be realized. In other words, capacitive driving that is generally applicable in a variety of connection environments (the type of the electro-optical panel connected to the driver, the design of a printed circuit board on which the driver is mounted, and so on, for example) can be realized.

According to another aspect of the invention, the detection circuit may carry out a second detection that detects a voltage at the data voltage output terminal in the case where the capacitance of the variable capacitance circuit is set to each of setting values, and the capacitance of the variable capacitance circuit may be set based on a detection result of the second detection.

When the capacitance of the variable capacitance circuit is set to a given setting value, a voltage according to that setting value will be outputted to the data voltage output terminal. By detecting the voltage at each of the setting values, the capacitance of the variable capacitance circuit can be set. For example, of the voltages at the setting values, detecting the voltage that matches (or is immediately nearby) a desired data voltage makes it possible to determine the capacitance of the variable capacitance circuit at which the desired data voltage corresponding to the tone data is obtained.

According to another aspect of the invention, the driver may further include a control circuit that outputs second detection data to the capacitor driving circuit instead of the tone data in the case where the second detection is carried out, and the control circuit may set the capacitance of the variable capacitance circuit based on a result of detecting a voltage, corresponding to the second detection data, at the data voltage output terminal.

By doing so, the second detection data is outputted to the capacitor driving circuit, which makes it possible to output a data voltage corresponding to the second detection data to the data voltage output terminal. This data voltage changes in accordance with the capacitance of the variable capacitance circuit, and thus the capacitance of the variable capacitance circuit can be set by detecting the capacitance at which the desired data voltage corresponding to the second detection data is obtained.

According to another aspect of the invention, an ith capacitor of the first to nth capacitors may have a capacitance value weighted by 2 to the power of (i−1) (where i is a natural number no greater than n); the control circuit may output the second detection data that causes the nth capacitor driving voltage, of the first to nth capacitor driving voltages, to switch from a first voltage level to a second voltage level that is higher than the first voltage level; and the detection circuit may detect, for each of the setting values for the capacitance of the variable capacitance circuit, whether or not the voltage at the data voltage output terminal will exceed a prescribed voltage in the case where the nth capacitor driving voltage has been switched from the first voltage level to the second voltage level.

Accordingly, the nth capacitor driving voltage is switched from the first voltage level to the second voltage level when the capacitance of the variable capacitance circuit is set to each setting value. The capacitance of the variable capacitance circuit can be determined by detecting whether or not the voltage at the data voltage output terminal exceeds the prescribed voltage when this switch is carried out. For example, if the desired data voltage corresponding to the second detection data is set to the prescribed voltage, the voltage at the data voltage output terminal will be near the prescribed voltage when the capacitance of the variable capacitance circuit at which the desired data voltage is obtained has been set. The capacitance of the variable capacitance circuit at that time may be used as a final setting value.

According to another aspect of the invention, the electro-optical panel may be driven by the capacitor driving circuit and the capacitor circuit under a condition that it has been determined, based on the detection result from the detection circuit, that the voltage at the data voltage output terminal does not exceed a breakdown voltage of the driver.

According to another aspect of the invention, the electro-optical panel may be driven by the capacitor driving circuit and the capacitor circuit under a condition that it has been determined, based on the detection result from the detection circuit, that the voltage at the data voltage output terminal does not exceed a breakdown voltage of the electro-optical panel.

According to these aspects of the invention, the capacitive driving can be started in the case where it can be determined, based on the result of the detection by the detection circuit, that the voltage at the data voltage output terminal will not exceed the breakdown voltage of the driver or the electro-optical panel due to the capacitive driving.

Another aspect of the invention concerns a driver including a capacitor driving circuit that outputs first to nth capacitor driving voltages (where n is a natural number of 2 or more) corresponding to tone data to first to nth capacitor driving nodes, and a capacitor circuit including first to nth capacitors provided between the first to nth capacitor driving nodes and a data voltage output terminal; the electro-optical panel is driven by the capacitor driving circuit and the capacitor circuit under a condition that it has been determined that a voltage at the data voltage output terminal does not exceed a breakdown voltage of the driver or a breakdown voltage of an electro-optical panel.

Another aspect of the invention concerns an electronic device including any of the drivers described above.

BRIEF DESCRIPTION OF THE DRAWINGS

The invention will be described with reference to the accompanying drawings, wherein like numbers reference like elements.

FIGS. 5A to 5C are diagrams illustrating data voltages in the first configuration example.

FIGS. 12A and 12B are diagrams illustrating a process for setting a capacitance of a variable capacitance circuit.

DESCRIPTION OF EXEMPLARY EMBODIMENTS

Hereinafter, preferred embodiments of the invention will be described in detail. Note that the embodiments described hereinafter are not intended to limit the content of the invention as described in the appended claims in any way, and not all of the configurations described in these embodiments are required as the means to solve the problems as described above.

1. First Example of Configuration of Driver

Figure 1:
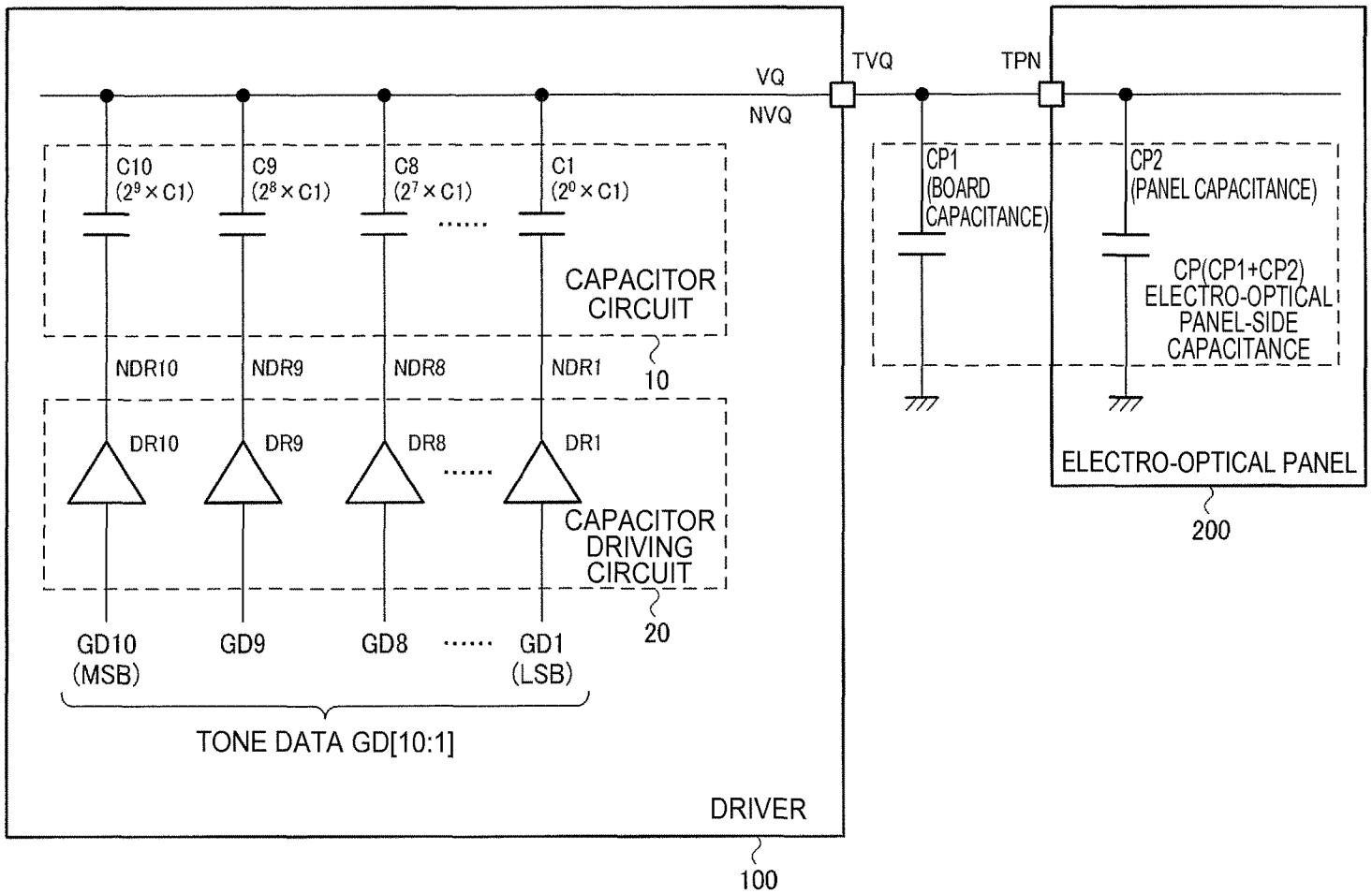
FIG. 1 illustrates a first example of the configuration of a driver.

FIG. 1 illustrates a first example of the configuration of a driver according to this embodiment. This driver 100 includes a capacitor circuit 10, a capacitor driving circuit 20, and a data voltage output terminal TVQ. Note that in the following, the same sign as a sign for a capacitor is used as a sign indicating a capacitance value of that capacitor.

The driver 100 is constituted by an integrated circuit (IC) device, for example. The integrated circuit device corresponds to an IC chip in which a circuit is formed on a silicon substrate, or a device in which an IC chip is held in a package, for example. Terminals of the driver 100 (the data voltage output terminal TVQ and so on) correspond to pads or package terminals of the IC chip.

The capacitor circuit 10 includes first to nth capacitors C1 to Cn (where n is a natural number of 2 or more). The capacitor driving circuit 20 includes first to nth driving units DR1 to DRn. Although the following describes a case where n=10 as an example, n may be any natural number greater than or equal to 2. For example, n may be set to the same number as the bit number of tone data.

One end of an ith capacitor in the capacitors C1 to C10 (where i is a natural number no greater than n, which is 10) is connected to a capacitor driving node NDRi, and another end of the ith capacitor is connected to a data voltage output node NVQ. The data voltage output node NVQ is a node connected to the data voltage output terminal TVQ. The capacitors C1 to C10 have capacitance values weighted by a power of 2. Specifically, the capacitance value of the ith capacitor Ci is $2^{(i-1)}\times C1$.

An ith bit GDi of tone data GD [10:1] is inputted into an input node of an ith driving unit DRi of the first to tenth driving units DR1 to DR10. An output node of the ith driving unit DRi corresponds to the ith capacitor driving node NDRi. The tone data GD [10:1] is constituted of first to tenth bits GD1 to GD10 (first to nth bits), where the bit GD1 corresponds to the LSB and the bit GD10 corresponds to the MSB.

The ith driving unit DRi outputs a first voltage level in the case where the bit GDi is at a first logic level and outputs a second voltage level in the case where the bit GDi is at a second logic level. For example, the first logic level is 0 (low-level), the second logic level is 1 (high-level), the first voltage level is a voltage at a low-potential side power source VSS (0 V, for example), and the second voltage level is a voltage at a high-potential side power source VDD (15 V, for example). For example, the ith driving unit DRi is constituted of a level shifter that level-shifts the inputted logic level (a 3 V logic power source, for example) to the output voltage level (15 V, for example) of the driving unit DRi, a buffer circuit that buffers the output of that level shifter, and so on.

As described above, the capacitance values of the capacitors C1 to C10 are weighted by a power of 2 that is based on the order of the bits GD1 to GD10 in the tone data GD [10:1]. The driving units DR1 to DR10 output 0 V or 15 V in accordance with the bits GD1 to GD10, and the capacitors C1 to C10 are driven by those voltages. As a result of this driving, charge redistribution occurs between the capacitors C1 to C10 and an electro-optical panel-side capacitance CP, and a data voltage is output to the data voltage output terminal TVQ as a result.

The electro-optical panel-side capacitance CP is the sum of capacitances as viewed from the data voltage output terminal TVQ. For example, the electro-optical panel-side capacitance CP is a result of adding a board capacitance CP1 that is parasitic capacitance of a printed circuit board with a panel capacitance CP2 that is parasitic capacitance, pixel capacitances, and the like within an electro-optical panel 200.

Specifically, the driver 100 is mounted on a rigid board as an integrated circuit device, a flexible board is connected to that rigid board, and the electro-optical panel 200 is connected to that flexible board. Interconnects are provided on the rigid board and the flexible board for connecting the data voltage output terminal TVQ of the driver 100 to a data voltage input terminal TPN of the electro-optical panel 200. Parasitic capacitance of these interconnects corresponds to the board capacitance CP1. Meanwhile, as will be described later with reference to FIG. 13, data lines connected to the data voltage input terminal TPN, source lines, switching elements that connect the data lines to the source lines, pixel circuits connected to the source lines, and so on are provided in the electro-optical panel 200. The switching elements are constituted by TFTs (Thin Film Transistors), for example, and there is parasitic capacitance between the sources and gates thereof. Many switching elements are connected to the data lines, and thus the parasitic capacitance of many switching elements is present on the data lines. Parasitic capacitance is also present between data lines, source lines, or the like and a panel substrate. In the liquid-crystal display panel, there is capacitance in the liquid-crystal pixels. The panel capacitance CP2 is the sum of those capacitances.

The electro-optical panel-side capacitance CP is 50 pF to 120 pF, for example. As will be described later, to ensure a ratio of 1:2 between a capacitance CO of the capacitor circuit 10 (the sum of the capacitances of the capacitors C1 to C10) and the electro-optical panel-side capacitance CP, the capacitance CO of the capacitor circuit 10 is 25 pF to 60 pF. Although large as a capacitance internal to an integrated circuit, the capacitance CO of the capacitor circuit 10 can be achieved by a cross-sectional structure that, for example, vertically stacks two to three levels of MIM (Metal Insulation Metal) capacitors.

2. Data Voltages

Next, data voltages outputted by the driver 100 with respect to the tone data GD [10:1] will be described. Here, it is assumed that the capacitance CO of the capacitor circuit 10 (=C1+C2+ . . . C10) is set to CP/2.

Figure 2A:
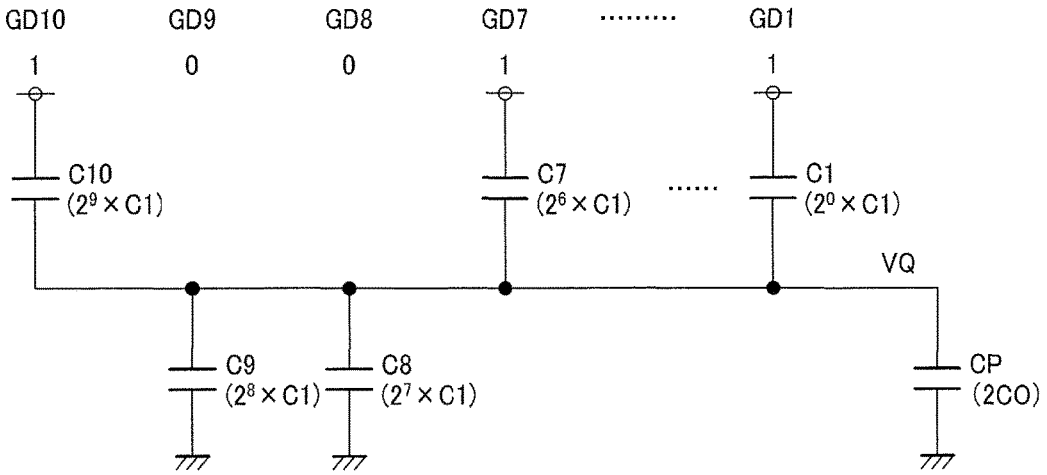
FIGS. 2A and 2B are diagrams illustrating data voltages corresponding to tone data.

As illustrated in FIG. 2A, the driving unit DRi outputs 0 V in the case where the ith bit GDi is "0", and the driving unit DRi outputs 15 V in the case where the ith bit GDi is "1". FIG. 2A illustrates an example of a case where GD[10:1]="1001111111b" (the b at the end indicates that the number within the " is binary).

First, a reset is carried out prior to driving. In other words, GD[10:1] is set to "0000000000b", 0 V is output to the driving units DR1 to DR10, and a voltage VQ is set to VC=7.5 V. VC=7.5 V corresponds to a reset voltage.

Figure 2B:
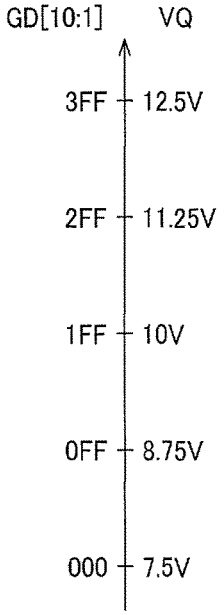

In this reset, a charge accumulated at the data voltage output node NVQ is also conserved in the driving carried out thereafter, and thus based on the principle of charge conservation, Formula FE in FIG. 2A is found. In Formula FE, the sign GDi expresses the value of the bit GDi ("0" or "1"). Looking at the second term on the right side of Formula FE, it can be seen that the tone data GD [10:1] is converted into 1,024-tone data voltages (5 V×0/1,023, 5 V×1/1,023, 5 V×2/1,023, . . . , 5 V×1,023/1,023). FIG. 2B illustrates a data voltage (the output voltage VQ) when the most significant three bits of the tone data GD [10:1] have been changed as an example.

Although positive-polarity driving has been described as an example thus far, it should be noted that negative-polarity driving may be carried out in this embodiment. Inversion driving that alternates positive-polarity driving and negative-polarity driving may be carried out as well. In negative-polarity driving, the outputs of the driving units DR1 to DR10 in the capacitor driving circuit 20 are all set to 15 V in the reset, and the output voltage VQ is set to VC=7.5 V. The logic level of each bit in the tone data GD [10:1] is inverted ("0" to "1" and "1" to "0"), inputted into the capacitor driving circuit 20, and capacitive driving is carried out. In this case, a VQ of 7.5 V is outputted with respect to tone data GD [10:1] of "000 h", a VQ of 2.5 V is outputted with respect to tone data GD [10:1] of "3 FFh", and the data voltage range becomes 7.5 V to 2.5 V.

3. Second Example of Configuration of Driver

As described above, the driver 100 and the electro-optical panel 200 are connected by the terminal TVQ of the driver, interconnects on the board, and the terminal TPN of the electro-optical panel 200. If a connection defect occurs in these terminals, interconnects are broken, or the like, the driver 100 and the electro-optical panel 200 will be in an incorrect connection state. In this case, there is a problem that a load-side capacitance in the capacitive driving will decrease (disappear).

For example, in the case where the terminal TVQ of the driver is not connected, the board capacitance CP1 and the panel capacitance CP2 will no longer be present, from the standpoint of the driver 100. Meanwhile, in the case where the terminal TPN of the electro-optical panel 200 is not connected, the panel capacitance CP2 will no longer be present, from the standpoint of the driver 100. Consider what will happen to the output voltage VQ in the case where the capacitance CP of the electro-optical panel 200 has decreased.

In Formula FE indicated in the aforementioned FIG. 2A, the coefficient in the second term on the right side is 5 V. This coefficient 5V is a coefficient present when the ratio between the capacitance CO of the capacitor circuit 10 and the electro-optical panel-side capacitance CP is 1:2, and the coefficient changes when CP changes. For example, the coefficient becomes 15 V when the electro-optical panel-side capacitance CP has become 0 due to a connection defect. In this case, VQ=7.5 V+15 V/2=15 V for a median value "1FF" of the tone data GD [10:1], and a power source voltage reaches 15 V, whereas VQ=7.5 V+15 V=22.5 V for a maximum value "3 FF" of the tone data GD [10:1], and the power source voltage exceeds 15 V.

If the driver 100 starts normal capacitive driving in this state, the output voltage VQ exceeding the power source voltage of 15 V will be applied to the data voltage output node NVQ. Because the breakdown voltage of the IC is approximately the same as the power source voltage of 15 V, there is the possibility that the output voltage VQ will exceed 15 V due to a connection defect such as those mentioned above and cause electrostatic breakdown in the IC. For example, as will be described later with reference to FIG. 6, the driver 100 may include a variable capacitance circuit 30 connected to the data voltage output node NVQ. In this case, it is possible that the electrostatic breakdown will extend to switching elements SWA1 to SWA6 and the like in the variable capacitance circuit 30.

Note that in the case where the variable capacitance circuit 30 is provided, the variable capacitance circuit 30 serves as the load-side capacitance, and the rise in voltage is reduced to a certain extent. However, in the case where the electro-optical panel-side capacitance CP has decreased due to a connection defect, the load-side capacitance will decrease, and the voltage VQ during the capacitive driving will nevertheless rise. For example, Formula FD in FIG. 7B indicates a maximum value of the data voltage when the variable capacitance circuit 30 is provided. CA represents the capacitance of the variable capacitance circuit 30. As can be seen from the upper right side of Formula FD, the maximum value of the data voltage rises as CP drops.

Figure 3:
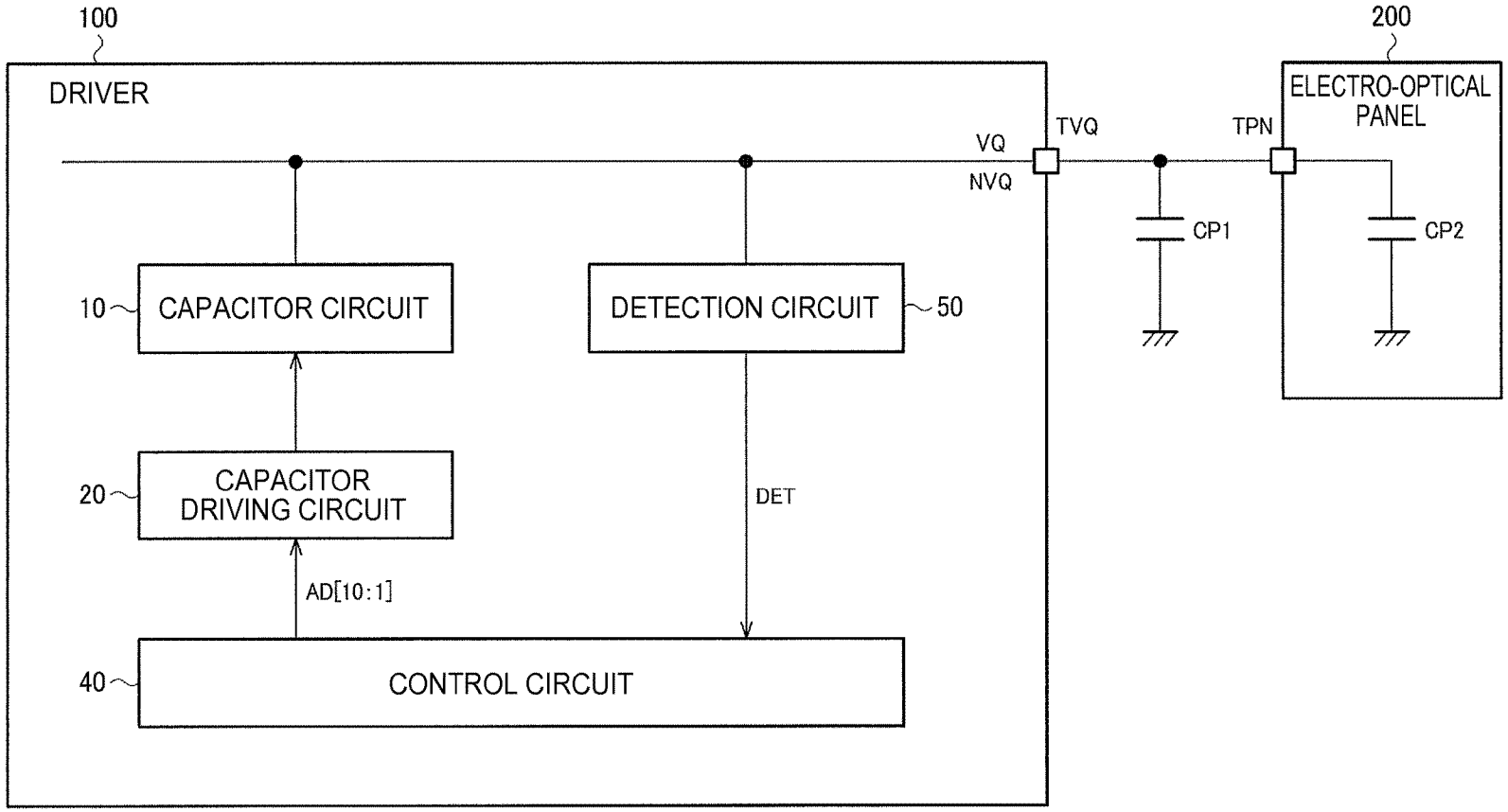
FIG. 3 illustrates a second example of the configuration of a driver.

FIG. 3 illustrates a second example of the configuration of a driver according to this embodiment, capable of solving the stated problem. This driver 100 includes the capacitor circuit 10, the capacitor driving circuit 20, a control circuit 40, a detection circuit 50, and the data voltage output terminal TVQ. Note that constituent elements that are the same as constituent elements already described are assigned the same reference numerals, and descriptions of those constituent elements are omitted as appropriate.

The detection circuit 50 is a circuit that detects the voltage VQ at the data voltage output node NVQ. Specifically, the detection circuit 50 compares a prescribed detection voltage with the voltage VQ and outputs a result thereof as a detection signal DET. For example, DET="1" is outputted in the case where the voltage VQ is greater than or equal to the detection voltage, and DET="0" is outputted in the case where the voltage VQ is less than the detection voltage.

The control circuit 40 is a circuit that controls the various units of the driver 100. Specifically, the control circuit 40 controls a timing at which the electro-optical panel 200 is driven, the output of tone data to the capacitor driving circuit 20, and so on. The control circuit 40 also outputs detection data AD[10:1] and drives the capacitor circuit 10, and detects a connection state between the driver 100 and the electro-optical panel 200 based on the detection signal DET at that time. The control circuit 40 starts capacitive driving in the case where it is determined that the two are correctly connected (that the two are not disconnected or incompletely connected). The capacitive driving is not started in the case where it is determined that the connection is not correct. Details of this detection process will be given later.

Figure 4:
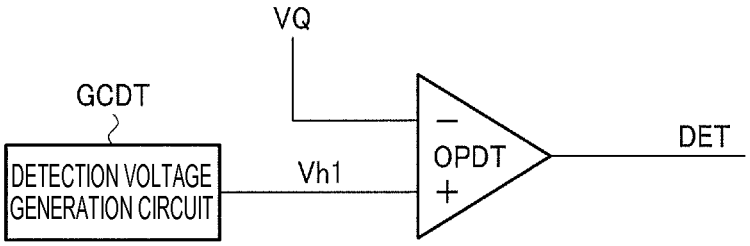
FIG. 4 illustrates an example of the detailed configuration of a detection circuit.

FIG. 4 illustrates an example of the detailed configuration of the detection circuit 50. The detection circuit 50 includes a detection voltage generation circuit GCDT that generates a detection voltage Vh1 and a comparator OPDT that compares the voltage VQ at the data voltage output node NVQ with the detection voltage Vh1.

The detection voltage generation circuit GCDT outputs the detection voltage Vh1, which is determined in advance by a voltage division circuit or the like using a resistance element, for example. Alternatively, a variable detection voltage Vh1 may be outputted through register settings or the like. In this case, the detection voltage generation circuit GCDT may be a D/A conversion circuit that D/A-converts a register setting value.

According to the second configuration example described thus far, the driver 100 includes the capacitor driving circuit 20, the capacitor circuit 10, and the detection circuit 50.

The capacitor driving circuit 20 outputs first to tenth capacitor driving voltages (0 V or 15 V), corresponding to the tone data GD [10:1], to first to tenth capacitor driving nodes NDR1 to NDR10. The capacitor circuit 10 has the first to tenth capacitors C1 to C10 provided between the first to tenth capacitor driving nodes NDR1 to NDR10 and the data voltage output terminal TVQ. The detection circuit 50 carries out a first detection that detects a connection state between the data voltage output terminal TVQ and the electro-optical panel 200.

As described above, in the case where the electro-optical panel 200 is not correctly connected to the driver 100, there is a problem that a voltage greater than the breakdown voltage (power source voltage) will be applied to the driver 100.

With respect to this point, according to the second configuration example, the connection state between the data voltage output terminal TVQ and the electro-optical panel 200 can be detected by the detection circuit 50. Accordingly, the driver 100 can be controlled in accordance with the detected connection state, and a voltage greater than the breakdown voltage can be prevented from being applied to the driver 100. For example, the driver 100 can be stopped (the capacitive driving not being carried out) in the case where it is determined that the data voltage output terminal TVQ and the electro-optical panel 200 are not connected based on a result of detecting the connection state.

Meanwhile, in this embodiment, the detection circuit 50 is a circuit that detects the voltage VQ at the data voltage output terminal TVQ.

Accordingly, by detecting the voltage VQ at the data voltage output terminal TVQ, the connection state between the data voltage output terminal TVQ and the electro-optical panel 200 can be detected. As will be described later with reference to FIGS. 5A to 5C, in capacitive driving, in the case where the electro-optical panel-side capacitance CP has changed, the data voltage will change as well, even when the tone data is the same. Accordingly, by detecting the voltage VQ at the data voltage output terminal TVQ, the magnitude of the capacitance connected to the data voltage output terminal TVQ can be estimated. It is therefore possible to detect the connection state between the data voltage output terminal TVQ and the electro-optical panel 200.

In addition, in this embodiment, the driver 100 includes the control circuit 40 that outputs first detection data AD[10:1] to the capacitor driving circuit 20 instead of the tone data GD [10:1] in the case where the first detection is carried out. The control circuit 40 then determines the connection state based on the result of detecting the voltage VQ at the data voltage output terminal TVQ corresponding to the first detection data AD[10:1].

By doing so, the first detection data AD[10:1] is outputted to the capacitor driving circuit 20, which makes it possible to output a data voltage corresponding to the first detection data AD[10:1] to the data voltage output terminal TVQ. This data voltage varies depending on the electro-optical panel-side capacitance CP, and the range of the data voltage is determined in accordance with an estimated range of the electro-optical panel-side capacitance CP. In other words, the electro-optical panel 200 can be determined to be correctly connected when the detected voltage VQ is within that data voltage range. On the other hand, a connection error can be determined to have occurred when the detected voltage VQ is outside the data voltage range. This determination method will be described in detail later with reference to FIGS. 9 to 10B.

In addition, in this embodiment, the ith capacitor Ci of the first to tenth capacitors C1 to C10 has a capacitance value weighted by 2 to the power of (i−1). The capacitor driving circuit 20 outputs a first voltage level (0 V) or a second voltage level (15 V) that is higher than the first voltage level as each of the first to tenth capacitor driving voltages. The control circuit 40 then outputs the first detection data AD[10:1], which sequentially increases the total capacitance of the capacitors, among the first to tenth capacitors C1 to C10, to which the second voltage level (15 V) is supplied.

Figure 9:
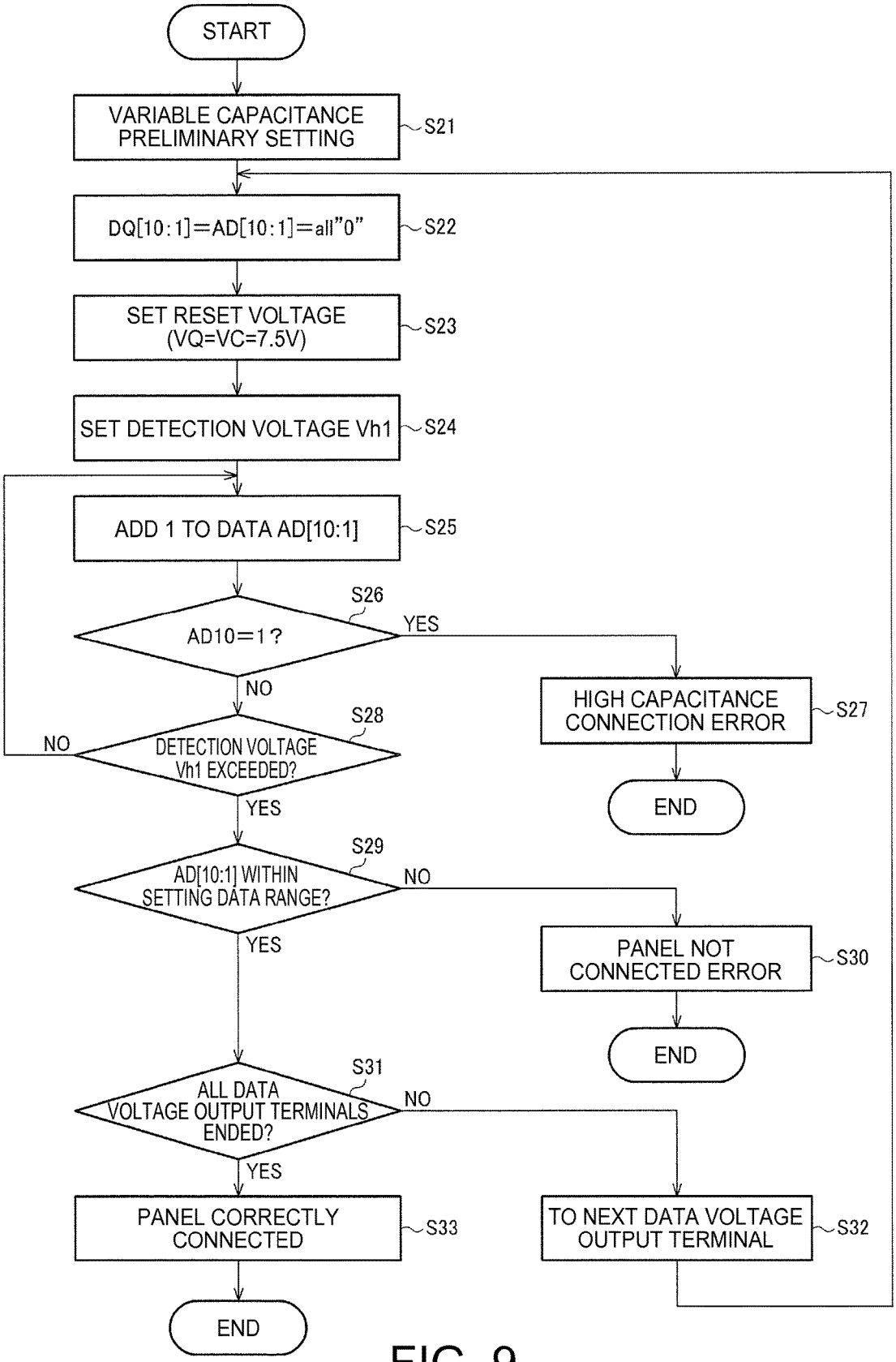
FIG. 9 is a flowchart illustrating a process for detecting a connection state.

For example, as illustrated in FIG. 9 and described later, the first detection data AD[10:1] is incremented by 1 at a time. As can be seen in FIG. 2A, the total capacitance of the capacitors to which 15 V is supplied increases as the tone data is incremented, and the voltage VQ rises as a result. As will be described with reference to FIG. 10B, in the case where the electro-optical panel 200 is not connected, the voltage VQ will rise quickly even in the case where the first detection data AD[10:1] is low, and thus by detecting that rise, the connection state of the electro-optical panel 200 can be detected.

Meanwhile, by starting from the capacitor to which 15 V is supplied having the lowest total capacitance, the voltage VQ can be prevented from rising suddenly in the first detection, and the likelihood of electrostatic breakdown can be reduced. In other words, in the case where the total capacitance of the capacitor to which 15 V is supplied is low, the redistributed charge is low, and thus the rise in the voltage VQ will be small even if the electro-optical panel 200 is not connected. In the case where the electro-optical panel 200 is not connected, the redistributed charge cannot exit the IC, and attempts to flow in transistors and the like in the IC, which can become a cause of electrostatic breakdown; however, the amount of charge that is supplied in this case is low, and thus such electrostatic breakdown is unlikely to occur.

In addition, in this embodiment, the driver 100 includes a register unit 48, as will be described later with reference to FIG. 8 and so on. The connection state detection result can be written into the register unit 48, and the connection state detection result can be read out by an external processing unit (a display controller 300).

Accordingly, by the external processing unit reading out the connection state detection result from the register unit 48, the driver 100 can be controlled in accordance with that connection state detection result. For example, a flag indicating a correct connection or a flag indicating an incorrect connection is written into the register unit 48 as the detection result. The external processing unit then causes the driver 100 to drive the electro-optical panel 200 (to display an image) in the case where the read-out flag is the flag indicating a correct connection. On the other hand, the external processing unit does not cause the driver 100 to drive the electro-optical panel 200 (to display an image) in the case where the read-out flag is the flag indicating an incorrect connection.

4. Third Example of Configuration of Driver

Next, consider again the data voltage in the first configuration example illustrated in FIG. 1. FIG. 2A assumes that the ratio between the capacitance CO of the capacitor circuit 10 and the electro-optical panel-side capacitance CP is set to 1:2, but a maximum value of the data voltage including cases where the ratio is not 1:2 will also be considered. As will be described hereinafter, if the driver 100 is to be created in a generic manner so as to be applicable in a variety of electro-optical panels 200, the ratio cannot be kept at 1:2, leading to a problem that the data voltage cannot be outputted in a constant range.

As illustrated in FIG. 5A, first, the capacitor circuit 10 is reset. In other words, "000 h" is set for the tone data GD [10:1] (the h at the end indicates that the number within the " is a hexadecimal) and all of the outputs of the driving units DR1 to DR10 are set to 0 V. Meanwhile, the voltage VQ is set to VC=7.5 V, as indicated by Formula FA in FIG. 5A. In this reset, the entire charge accumulated in the capacitance CO of the capacitor circuit 10 and the electro-optical panel-side capacitance CP is conserved in the following data voltage output. Through this, data voltage that takes a reset voltage VC (a common voltage) as a reference is outputted.

As illustrated in FIG. 5B, the maximum value of the data voltage is outputted in the case where the tone data GD [10:1] is set to "3 FFh" and the outputs of all of the driving units DR1 to DR10 are set to 15 V. The data voltage at this time can be found from the principle of the conservation of charge, and is a value indicated by Formula FB in FIG. 5B.

As illustrated in FIG. 5C, a desired data voltage range is assumed to be 5 V, for example. Because the reset voltage VC of 7.5 V is the reference, the maximum value is 12.5 V. This data voltage is realized when, based on the Formula FB, CO/(CO+CP)=1/3. In other words, relative to the electro-optical panel-side capacitance CP, the capacitance CO of the capacitor circuit 10 may be set to CP/2 (in other words, CP=2CO). The 5 V data voltage range can be realized by designing CO to be equal to CP/2 in this manner for a specific electro-optical panel 200 and a mounting board.

However, depending on the type of the electro-optical panel 200, the design of the mounting board, and so on, the electro-optical panel-side capacitance CP has a range of approximately 50 pF to 120 pF. Meanwhile, even with the same types of electro-optical panel 200 and mounting board, in the case where a plurality of electro-optical panels are connected (when connecting three R, G, and B electro-optical panels in a projector, for example), the lengths of wires for connecting the respective electro-optical panels to drivers differ, and thus the board capacitance CP1 will not necessary be the same.

For example, assume that the design is such that the capacitance CO of the capacitor circuit 10 for a given electro-optical panel 200 and mounting board is CP=2CO. In the case where a different type of electro-optical panel or mounting board is connected to this capacitor circuit 10, CP may become CO/2, 5CO, or the like. In the case where CP=CO/2, the maximum value of the data voltage will become 17.5 V, exceeding the power source voltage of 15 V, as illustrated in FIG. 5C. In this case, there is a problem not only in terms of the data voltage range but also in terms of the breakdown voltages of the driver 100, the electro-optical panel 200, and so on. Meanwhile, in the case where CP=5CO, the maximum value of the data voltage is 10 V, and thus a sufficient data voltage range cannot be achieved.

As such, in the case where the capacitance CO of the capacitor circuit 10 is set in accordance with the electro-optical panel-side capacitance CP, there is an issue that a dedicated design is necessary for the driver 100 with respect to the electro-optical panel 200, the mounting board, or the like. In other words, each time the type of the electro-optical panel 200, the design of the mounting board, or the like is changed, it is necessary to redesign the driver 100 specifically therefor.

Figure 6:
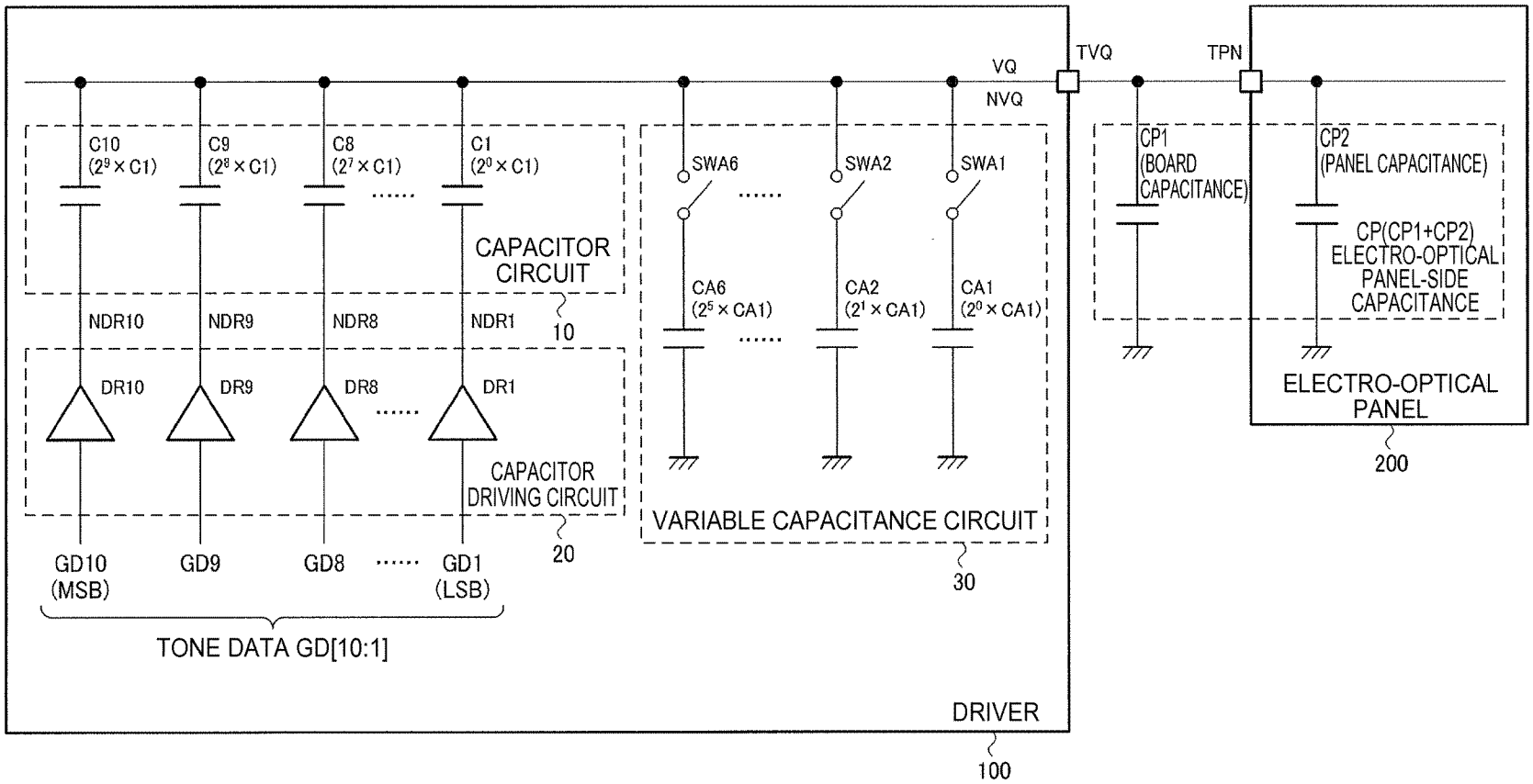
FIG. 6 illustrates a third example of the configuration of a driver.

FIG. 6 illustrates a third example of the configuration of a driver according to this embodiment, capable of solving the stated problem. This driver 100 includes the capacitor circuit 10, the capacitor driving circuit 20, and the variable capacitance circuit 30. Note that constituent elements that are the same as constituent elements already described are assigned the same reference numerals, and descriptions of those constituent elements are omitted as appropriate.

The variable capacitance circuit 30 is a circuit, serving as a capacitance connected to the data voltage output node NVQ, whose capacitance value can be set in a variable manner. Specifically, the variable capacitance circuit 30 includes first to mth switching elements SWA1 to SWAm (where m is a natural number of 2 or more), and first to mth adjusting capacitors CA1 to CAm. Note that the following will describe an example in which m=6.

The first to sixth switching elements SWA1 to SWA6 are configured as, for example, P-type or N-type MOS transistors, or as transfer gates that combine a P-type MOS transistor and an N-type MOS transistor. Of the switching elements SWA1 to SWA6, one end of an sth switching element SWAs (where s is a natural number no greater than m, which is 6) is connected to the data voltage output node NVQ.

The first to sixth adjusting capacitors CA1 to CA6 have capacitance values weighted by a power of 2. Specifically, of the adjusting capacitors CA1 to CA6, an sth adjusting capacitor CAs has a capacitance value of $2^{(s-1)}\times$CA1. One end of the sth adjusting capacitor CAs is connected to another end of the sth switching element SWAs. Another end of the sth adjusting capacitor CAs is connected to a low-potential side power source (broadly defined as a reference voltage node).

For example, in the case where CA1 is set to 1 pF, the capacitance of the variable capacitance circuit 30 is 1 pF while only the switching element SWA1 is on, whereas the capacitance of the variable capacitance circuit 30 is 63 pF (=1 pF+2 pF+ . . . +32 pF) while all the switching elements SWA1 to SWA6 are on. Because the capacitance values are weighted by a power of 2, the capacitance of the variable capacitance circuit 30 can be set from 1 pF to 63 pF in 1 pF (CA1) steps in accordance with whether the switching elements SWA1 to SWA6 are on or off.

5. Data Voltages in Third Configuration Example

Data voltages outputted by the driver 100 according to this embodiment will be described. Here, a range of the data voltages (a data voltage maximum value) will be described.

Figure 7A:
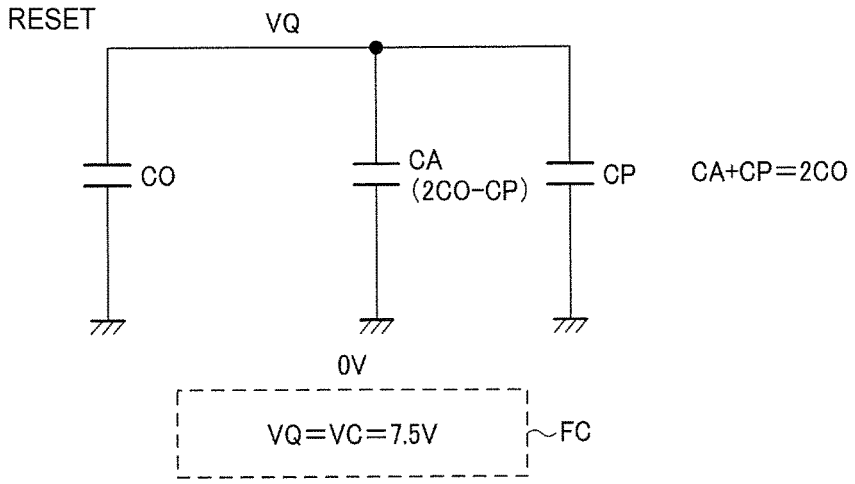
FIGS. 7A to 7C are diagrams illustrating data voltages in the third configuration example.

As illustrated in FIG. 7A, first, the capacitor circuit 10 is reset. In other words, the outputs of all the driving units DR1 to DR10 are set to 0 V and the voltage VQ is set to VC=7.5 V (Formula FC). In this reset, the entire charge accumulated in the capacitance CO of the capacitor circuit 10, a capacitance CA of the variable capacitance circuit, and the electro-optical panel-side capacitance CP is stored in the following data voltage output.

Figure 7B:
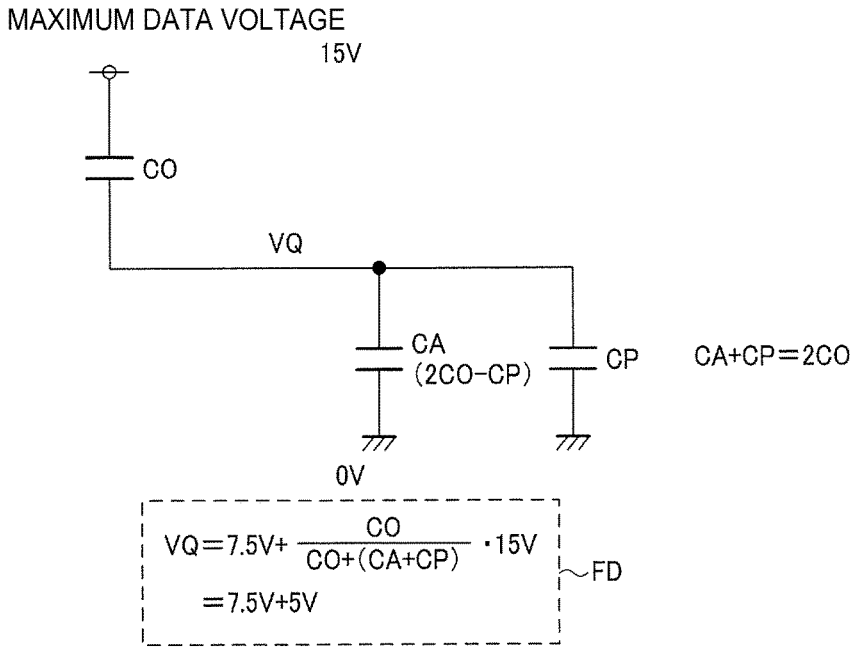

As illustrated in FIG. 7B, the maximum value of the data voltage is outputted in the case where the outputs of all of the driving units DR1 to DR10 are set to 15 V. The data voltage in this case is a value indicated by Formula FD in FIG. 7B.

Figure 7C:
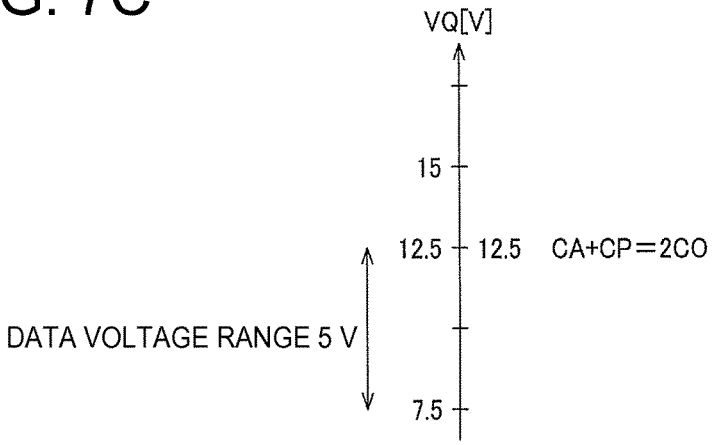

As illustrated in FIG. 7C, a desired data voltage range is assumed to be 5 V, for example. The maximum value of 12.5 V for the data voltage is realized in the case where, from Formula FD, CO/(CO+(CA+CP))=1/3, or in other words, in the case where CA+CP=2CO. CA is the capacitance of the variable capacitance circuit, and can thus be set freely, which in turn means that the CA can be set to 2CO−CP for the provided CP. In other words, regardless of the type of the electro-optical panel 200 connected to the driver 100, the design of the mounting board, or the like, the data voltage range can always be set to 7.5 V to 12.5 V.

According to the third configuration example described thus far, the driver 100 includes the variable capacitance circuit 30. The variable capacitance circuit 30 is provided between the data voltage output terminal TVQ and a node at a reference voltage (the voltage of the low-potential side power source, namely 0 V). Then, the capacitance CA of the variable capacitance circuit 30 is set so that a capacitance CA+CP obtained by adding the capacitance CA of the variable capacitance circuit 30 and the electro-optical panel-side capacitance CP (this will be called a "driven-side capacitance" hereinafter) and the capacitance CO of the capacitor circuit 10 (this will be called a "driving-side capacitance" hereinafter) have a prescribed capacitance ratio relationship (CO:(CA+CP)=1:2, for example).

Here, the capacitance CA of the variable capacitance circuit 30 is a capacitance value set for the variable capacitance of the variable capacitance circuit 30. In the example of FIG. 6, this is obtained by taking the total of the capacitances of the adjusting capacitors connected to switching elements, of the switching elements SWA1 to SWA6, that are on. Meanwhile, the electro-optical panel-side capacitance CP is a capacitance externally connected to the data voltage output terminal TVQ (parasitic capacitance, circuit element capacitance). In the example illustrated in FIG. 6, this is the board capacitance CP1 and the panel capacitance CP2. Meanwhile, the capacitance CO of the capacitor circuit 10 is the total of the capacitances of the capacitors C1 to C10.

The prescribed capacitance ratio relationship refers to a relationship in a ratio between the driving-side capacitance CO and the driven-side capacitance CA+CP. This is not limited to a capacitance ratio in the case where the values of each capacitance are measured (where the capacitance value are explicitly determined). For example, the capacitance ratio may be estimated from the output voltage VQ for prescribed tone data GD [10:1]. The electro-optical panel-side capacitance CP is normally not a measured value obtained in advance, and thus the capacitance CA of the variable capacitance circuit 30 cannot be determined directly. Accordingly, as will be described later with reference to FIG. 11, the capacitance CA of the variable capacitance circuit 30 is determined so that, for example, a VQ of 10 V is outputted for a median value "200 h" of the tone data GD [10:1]. In this case, the capacitance ratio is ultimately estimated as being CO:(CA+CP)=1:2, and the capacitance CP can be estimated from this ratio and the capacitance CA (can be estimated, but the capacitance CP need not be known).

In the first configuration example illustrated in FIG. 1 and the like, there is an issue in that a design change is necessary each time the connection environment of the driver 100 (the design of the mounting board, the type of the electro-optical panel 200, or the like) changes.

With respect to this point, according to the third configuration example, a generic driver 100 that does not depend on the connection environment of the driver 100 can be realized by providing the variable capacitance circuit 30. In other words, even in the case where the electro-optical panel-side capacitance CP is different, the prescribed capacitance ratio relationship (for example, CO:(CA+CP)=1:2) can be realized by adjusting the capacitance CA of the variable capacitance circuit 30 in accordance therewith. The data voltage range (7.5 V to 12.5 V in the example illustrated in FIGS. 7A to 7C) is determined by this capacitance ratio relationship, and thus a data voltage range that does not depend on the connection environment can be realized.

Meanwhile, in the capacitive driving carried out by the capacitor circuit 10 and the capacitor driving circuit 20, the pixels are driven by charge redistribution, and thus the data voltages can be written to the pixels at higher speeds than through amplifier driving (that is, the data voltages are settled in a short amount of time). Because higher speeds are possible, an electro-optical panel having a higher number of pixels (that is, a higher resolution) can be driven. In capacitive driving, charges are not supplied freely in the same manner as amplifier driving, but providing the variable capacitance circuit 30 makes it possible to adjust the charges supplied to the pixels. In other words, by providing the variable capacitance circuit 30, higher speeds can be realized through capacitive driving, and desired data voltages can be outputted.

In addition, in this embodiment, the capacitor driving circuit 20 outputs the first voltage level (0 V) or the second voltage level (15 V) as driving voltages corresponding to the respective first to tenth capacitor driving voltages, based on the first to tenth bits GD1 to GD10 of the tone data GD [10:1]. The prescribed capacitance ratio relationship is determined by a voltage relationship between a voltage difference between the first voltage level and the second voltage level (15 V) and the data voltage outputted to the data voltage output terminal TVQ (the output voltage VQ).

In the example illustrated in FIGS. 7A to 7C, the range of data voltages outputted to the data voltage output terminal TVQ is 5 V (7.5 V to 12.5 V), for example. In this case, the prescribed capacitance ratio relationship is determined so that the voltage relationship is realized between the voltage difference between the first voltage level and the second voltage level (15 V) and the data voltage range (5 V). In other words, a capacitance ratio of CO:(CA+CP)=1:2 at which 15 V is divided to 5 V through voltage division by the capacitance CO and the capacitance CA+CP becomes the prescribed capacitance ratio relationship.

By doing so, the prescribed capacitance ratio relationship of CO:(CA+CP)=1:2 can be determined from the voltage relationship between the voltage difference between the first voltage level and the second voltage level (15 V) and the range of data voltages outputted to the data voltage output terminal TVQ (a range of 5 V). Conversely, whether or not the prescribed capacitance ratio relationship is realized can be determined by examining the voltage relationship. In other words, even if the electro-optical panel-side capacitance CP is not known, the capacitance CA of the variable capacitance circuit 30 at which the capacitance ratio of CO:(CA+CP)=1:2 is realized can be determined from the voltage relationship (the flow illustrated in FIG. 11, for example).

6. Detailed Example of Configuration of Driver

Figure 8:
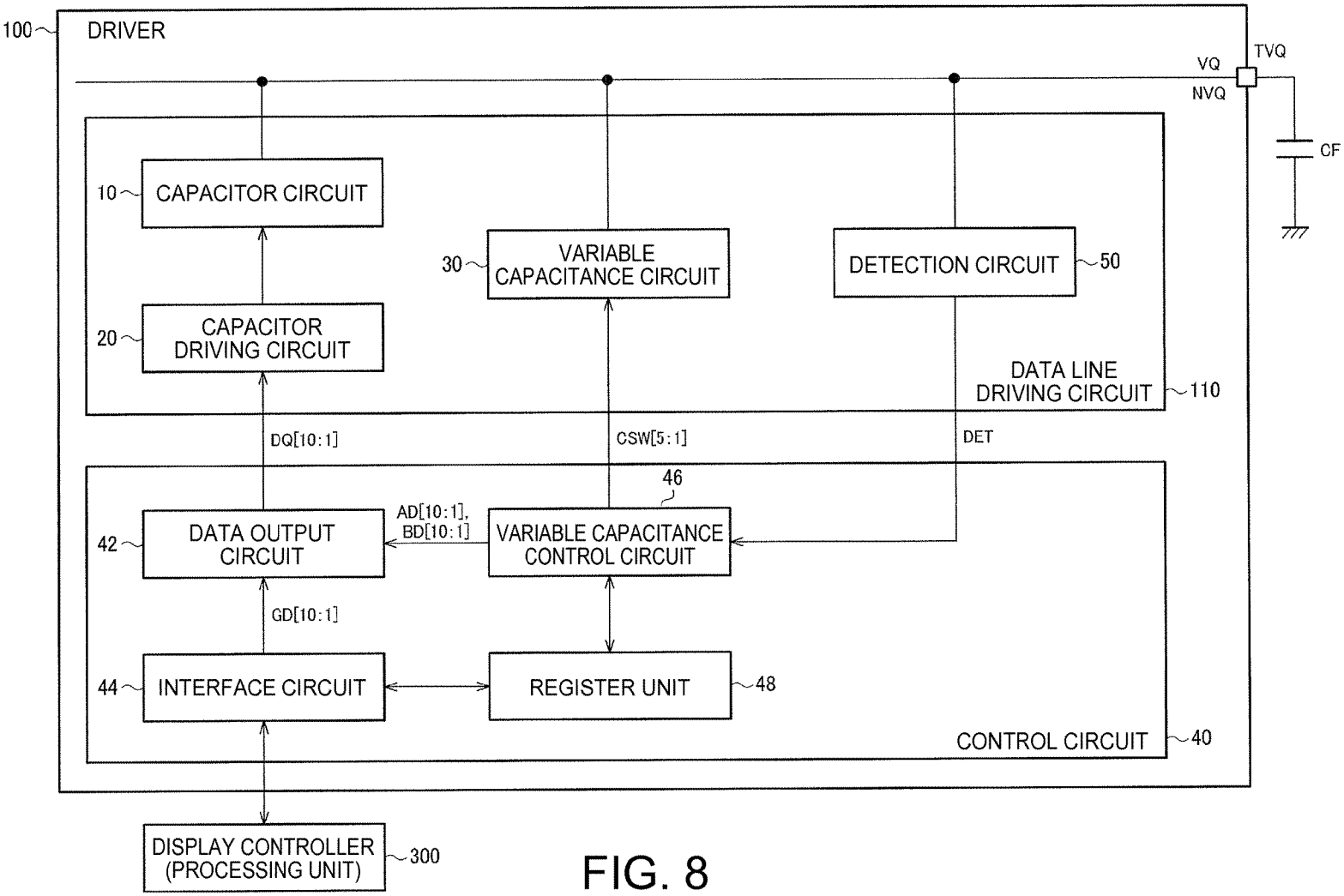
FIG. 8 illustrates an example of the detailed configuration of a driver.

FIG. 8 illustrates a detailed example of the configuration of the driver according to this embodiment. This driver 100 includes a data line driving circuit 110 and the control circuit 40. The data line driving circuit 110 includes the capacitor circuit 10, the capacitor driving circuit 20, the variable capacitance circuit 30, and the detection circuit 50. The control circuit 40 includes a data output circuit 42, an interface circuit 44, a variable capacitance control circuit 46, and the register unit 48. Note that constituent elements that are the same as constituent elements already described are assigned the same reference numerals, and descriptions of those constituent elements are omitted as appropriate.

A single data line driving circuit 110 is provided corresponding to a single data voltage output terminal TVQ. Although the driver 100 includes a plurality of data line driving circuits and a plurality of data voltage output terminals, only one is illustrated in FIG. 8.

The interface circuit 44 carries out an interfacing process between a display controller 300 (broadly defined as a processing unit) that controls the driver 100 and the driver 100. For example, the interfacing process is carried out through serial communication such as LVDS (Low Voltage Differential Signaling) or the like. In this case, the interface circuit 44 includes an I/O circuit that inputs/outputs serial signals and a serial/parallel conversion circuit that carries out serial/parallel conversion on control data, image data, and so on. Meanwhile, a line latch that latches the image data inputted from the display controller 300 and converted into parallel data is also included. The line latch latches image data corresponding to a single horizontal scanning line at one time, for example.

The data output circuit 42 extracts the tone data GD [10:1] to be outputted to the capacitor driving circuit 20 from the image data corresponding to the horizontal scanning line, and outputs this data as data DQ[10:1]. The data output circuit 42 includes, for example, a timing controller that controls a driving timing of the electro-optical panel 200, a selection circuit that selects the tone data GD [10:1] from the image data corresponding to the horizontal scanning line, and an output latch that latches the selected tone data GD [10:1]. As will be described later with reference to FIG. 13 and so on, in the case of phase expansion driving, the output latch latches eight pixels' worth of the tone data GD [10:1] (equivalent to the number of data lines DL1 to DL8) at one time. In this case, the timing controller controls the operational timing of the selection circuit, the output latch, and so on in accordance with the driving timing of the phase expansion driving. Meanwhile, a horizontal synchronization signal, a vertical synchronization signal, and so on may be generated based on the image data received by the interface circuit 44. Furthermore, a signal (ENBX) for controlling the switching elements (SWEP1 and the like) in the electro•optical panel 200 on and off, a signal for controlling gate driving (selection of horizontal scanning lines in the electro-optical panel 200), and so on may be outputted to the electro-optical panel 200.

The detection circuit 50 detects the connection state of the electro-optical panel 200 (a first detection) as described above. The detection circuit 50 also carries out a detection for setting the capacitance of the variable capacitance circuit 30 (a second detection). Results of these detection processes are outputted to the variable capacitance control circuit 46 as the detection signal DET.

The variable capacitance control circuit 46 determines the connection state of the electro-optical panel 200 based on the detection signal DET and stores a result of the determination in the register unit 48. The flow of this connection state detection process will be described later with reference to FIG. 9. In the case where this process is carried out, the variable capacitance control circuit 46 outputs the first detection data AD[10:1]. Then, the data output circuit 42 outputs the first detection data AD[10:1] to the capacitor driving circuit 20 as the output data DQ[10:1].

In addition, the variable capacitance control circuit 46 sets the capacitance of the variable capacitance circuit 30 based on the detection signal DET. The flow of this setting process will be described later with reference to FIG. 11. The variable capacitance control circuit 46 outputs a setting value CSW[6:1] as a control signal for the variable capacitance circuit 30. This setting value CSW[6:1] is constituted of first to sixth bits CSW1 to CSW6 (first to mth bits). A bit CSWs (where s is a natural number no greater than m, which is 6) is inputted into the switching element SWAs of the variable capacitance circuit 30. For example, in the case where the bit CSWs="0", the switching element SWAs turns off, whereas in the case where the bit CSWs="1", the switching element SWAs turns on. In the case where the setting process is carried out, the variable capacitance control circuit 46 outputs detection data BD[10:1]. Then, the data output circuit 42 outputs the detection data BD[10:1] to the capacitor driving circuit 20 as the output data DQ[10:1].

The register unit 48 stores connection information of the electro-optical panel 200 detected through the connection state detection process and the setting value CSW[6:1] of the variable capacitance circuit 30 set through the setting process. The register unit 48 is configured to be accessible from the display controller 300 via the interface circuit 44. In other words, the display controller 300 can read out the connection information, the setting value CSW[6:1], and so on from the register unit 48. Alternatively, the configuration may be such that the display controller 300 can write the setting value CSW[6:1] into the register unit 48.

7. Process for Detecting Connection State (First Detection)

FIG. 9 is a flowchart illustrating a process for detecting the connection state of the electro-optical panel 200. This process is carried out, for example, during startup (an IC initialization process) when the power of the driver 100 is turned on.

As illustrated in FIG. 9, when the process starts, the capacitance of the variable capacitance circuit 30 is preliminarily set (step S21). For example, the setting value CSW [6:1] is set to a maximum value ("3 Fh").

Next, the detection data AD[10:1] of "000 h" is outputted, and the outputs of all of the driving units DR1 to DR10 of the capacitor driving circuit 20 are set to 0 V (step S22). Next, the output voltage VQ is set to the reset voltage VC of 7.5 V (step S23). This reset voltage VC is supplied, for example, from the exterior via a terminal.

Then, the detection voltage Vh1 is set to a desired voltage (step S24). For example, the detection voltage Vh1 is set as appropriate in accordance with the preliminarily-set value for the variable capacitance circuit 30 and an estimated range of variation in the electro-optical panel-side capacitance CP.

Next, the detection data AD[10:1] is set to AD[10:1]+1 (step S25). Next, it is determined whether or not the MSB of the detection data AD[10:1] is AD10=1 (step S26). In the case where AD10=1, it is determined that a capacitance that exceeds the estimated range of variation in the electro-optical panel-side capacitance CP is connected, and the process is ended (step S27). In this case, an error flag indicating an error in the connection state ("1", for example) is written into the register unit 48. The display controller 300 accesses the register unit 48 and carries out error control in the case where the error flag has been confirmed. For example, the driver 100 is stopped without transiting to capacitive driving (that is, without transferring image data to the driver 100).

In the case where AD10=0 in step S27, it is detected whether or not the output voltage VQ is greater than or equal to the detection voltage Vh1 (step S28). The process returns to step S25 in the case where the output voltage VQ is lower than the detection voltage Vh1. On the other hand, in the case where the output voltage VQ is greater than or equal to the detection voltage Vh1, it is determined whether or not the detection data AD[10:1] is within a prescribed setting data range (step S29). The setting data range is set in accordance with the detection voltage Vh1, the preliminarily-set value for the variable capacitance circuit 30, and the estimated range of variation in the electro-optical panel-side capacitance CP. In the case where the detection data AD[10:1] is not within the setting data range, it is determined that the electro-optical panel 200 is not connected (that is, that the capacitance is lower than the estimated range of variation in the electro-optical panel-side capacitance CP), and the process is ended (step S30). In this case, the error flag indicating an error in the connection state ("1", for example) is written into the register unit 48. As in step S27, the capacitive driving is not carried out.

In the case where the detection data AD[10:1] is within the setting data range in step S29, it is determined whether or not the connection state detections have ended for all of the data voltage output terminals (step S31). In the case where the detections have not ended, the next data voltage output terminal is selected (step S32), and the process returns to step S22. In the case where the detections have ended, it is determined that the electro-optical panel 200 is connected correctly, and the process ends. In this case, a correct flag indicating that the connection state is correct ("0", for example) is written into the register unit 48. The display controller 300 accesses the register unit 48, and in the case where the correct flag has been confirmed, instructs the driver 100 to drive the electro-optical panel 200 and starts the capacitive driving.

Figure 10A:
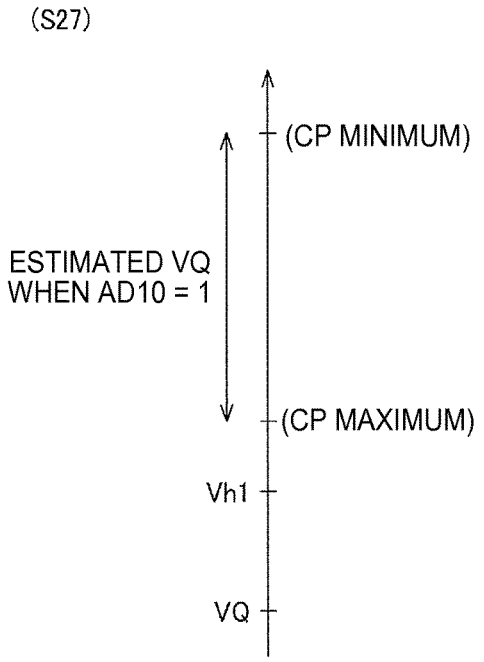
FIGS. 10A and 10B are diagrams illustrating a process for detecting a connection state.
Figure 10B:
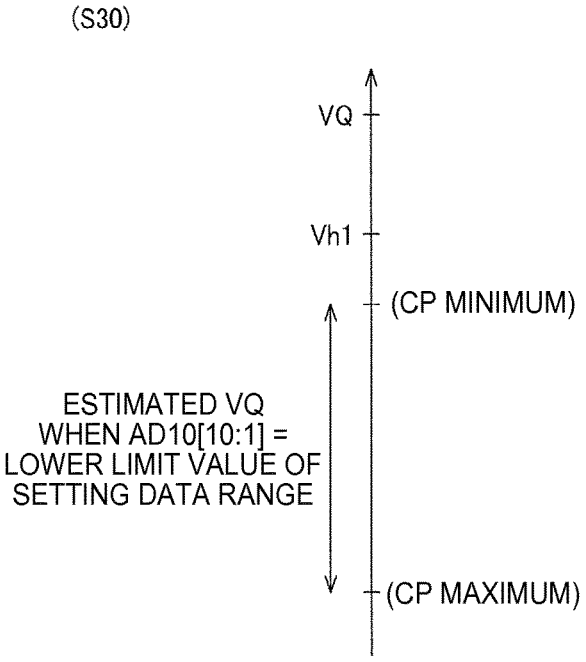

FIGS. 10A and 10B schematically illustrate the connection error being detected through the stated steps S25 to S30.

FIG. 10A corresponds to a high-capacitance connection error in step S27. Unless VQ≥Vh1 is determined in step S28, the loop of steps S25 to S28 continues, and the detection data AD[10:1] is incremented in order from "0" and reaches "200 h" (AD10=1). At this time, the output voltage VQ is a voltage corresponding to AD[10:1]="200 h". If the voltage VQ does not exceed the detection voltage Vh1, it can be determined that a greater capacitance than anticipated is connected to the data voltage output terminal TVQ.

In other words, because the variable capacitance circuit 30 is fixed at the preliminarily-set value, the voltage VQ varies in accordance with the electro-optical panel-side capacitance CP, as can be seen from Formula FD in FIG. 7B. The range of the electro-optical panel-side capacitance CP can be estimated based on the model of the electro-optical panel 200 assumed to be used, for example. A range of the voltage VQ when AD[10:1]="200 h" can be estimated in accordance with the estimated range of the electro-optical panel-side capacitance CP. Based on Formula FD, the voltage VQ drops as the electro-optical panel-side capacitance CP rises. In other words, a minimum value of the estimated range of the voltage VQ corresponds to a maximum value of the estimated range of the electro-optical panel-side capacitance CP. The detection voltage Vh1 is set to a value that is lower than the minimum value of the range of the voltage VQ, and the detection voltage Vh1 not being exceeded means that a larger capacitance than the maximum value of the range of the electro-optical panel-side capacitance CP is connected.

Next, FIG. 10B corresponds to a panel unconnected error in step S30. Reaching step S29 means that the voltage VQ has exceeded the detection voltage Vh1 before AD[10:1] has reached "200 h", and thus in step S29, AD[10:1]<"200 h". In the case where the detection data AD[10:1] at this time is not within the prescribed setting data range, it can be determined that a lower capacitance than anticipated is connected to the data voltage output terminal TVQ (or that no capacitance at all is connected).

For example, the setting data range is a range greater than a prescribed lower limit value and lower than "200 h". Assume that the detection data AD[10:1] is this prescribed lower limit value. In this case, the range of the voltage VQ can be estimated in accordance with the range of the electro-optical panel-side capacitance CP, in the same manner as illustrated in FIG. 10A. The lower limit value of the setting data range is set so that the range of the voltage VQ is lower than the detection voltage Vh1. In the case where the voltage VQ exceeds the detection voltage Vh1 at the point in time when the detection data AD[10:1] has reached the prescribed lower limit value, this means that the actual voltage VQ is greater than the maximum value of the estimated range of the voltage VQ. The maximum value of the estimated range of the voltage VQ corresponds to the minimum value of the estimated range of the electro-optical panel-side capacitance CP, and thus it can be determined that lower capacitance than anticipated is connected (or no capacitance at all is connected).

As the detection data AD[10:1] is incremented, the voltage VQ rises. In other words, the voltage VQ exceeding the detection voltage Vh1 at the point in time when the detection data AD[10:1] has reached the prescribed lower limit value means that the voltage VQ exceeds the detection voltage Vh1 before the detection data AD[10:1] reaches the prescribed lower limit value (outside of the prescribed setting data range). Accordingly, the panel unconnected error is detected in steps S29 and S30.

8. Process for Setting Capacitance of Variable Capacitance Circuit (Second Detection)

Figure 11:
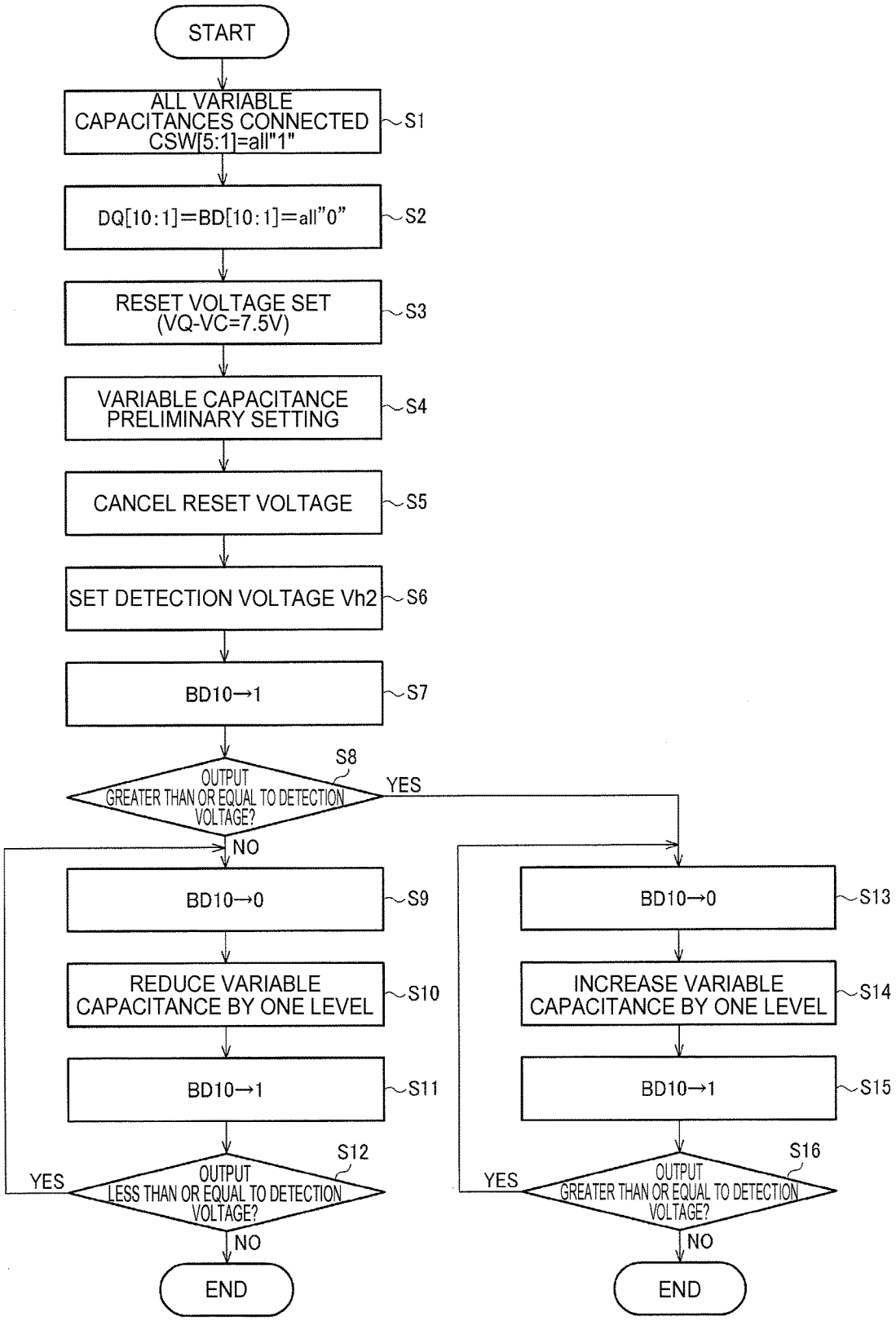
FIG. 11 is a flowchart illustrating a process for setting a capacitance of a variable capacitance circuit.

FIG. 11 is a flowchart illustrating a process for setting the capacitance of the variable capacitance circuit 30. This process is carried out, for example, during startup (an initialization process) when the power of the driver 100 is turned on.

As illustrated in FIG. 11, when the process starts, the setting value CSW[6:1] of "3 Fh" is outputted, and all of the switching elements SWA1 to SWA6 of the variable capacitance circuit 30 are turned on (step S1). Next, the detection data BD[10:1] of "000 h" is outputted, and the outputs of all of the driving units DR1 to DR10 of the capacitor driving circuit 20 are set to 0 V (step S2). Next, the output voltage VQ is set to the reset voltage VC of 7.5 V (step S3). This reset voltage VC is supplied, for example, from the exterior via a terminal.

Next, the capacitance of the variable capacitance circuit 30 is preliminarily set (step S4). For example, the setting value CSW[6:1] is set to "1 Fh". In this case, the switching element SWA6 turns off and the switching elements SWA5 to SWA1 turn on, and thus the capacitance is half the maximum value. Next, the supply of the reset voltage VC to the output voltage VQ is canceled (step S5). Then, the detection voltage Vh2 is set to a desired voltage (step S6). For example, the detection voltage Vh2 is set to 10 V.

Next, the MSB of the detection data BD[10:1] is changed from BD10="0" to BD10="1" (step S7). Then, it is detected whether or not the output voltage VQ is greater than or equal to the detection voltage Vh2 of 10 V (step S8).

In the case where the output voltage VQ is less than the detection voltage Vh2 of 10 V in step S8, the bit BD10 is returned to "0" (step S9). Next, 1 is subtracted from the setting value CSW[6:1] of "1 Fh" for "1 Eh" and the capacitance of the variable capacitance circuit 30 is lowered by one level (step S10). Next, the bit BD10 is set to "1" (step S11). Then, it is detected whether or not the output voltage VQ is less than or equal to the detection voltage Vh2 of 10 V (step S12). The process returns to step S9 in the case where the output voltage VQ is less than or equal to the detection voltage Vh2 of 10 V, and the process ends in the case where the output voltage VQ is greater than the detection voltage Vh2 of 10 V.

In the case where the output voltage VQ is greater than or equal to the detection voltage Vh2 of 10 V in step S8, the bit BD10 is returned to "0" (step S13). Next, 1 is added to the setting value CSW[6:1] of "1 Fh" for "20 h" and the capacitance of the variable capacitance circuit 30 is raised by one level (step S14). Next, the bit BD10 is set to "1" (step S15). Then, it is detected whether or not the output voltage VQ is greater than or equal to the detection voltage Vh2 of 10 V (step S16). The process returns to step S13 in the case where the output voltage VQ is greater than or equal to the detection voltage Vh2 of 10 V, and the process ends in the case where the output voltage VQ is less than the detection voltage Vh2 of 10 V.

FIGS. 12A and 12B schematically illustrate the setting value CSW[6:1] being determined through the stated steps S8 to S16.

In the aforementioned flow, the MSB of the detection data BD[10:1] is set to BD10="1", and the output voltage VQ at that time is compared to the detection voltage Vh2 of 10 V. BD[10:1]="200 h" is a median value of the tone data range "000 h" to "3 FFh", and the detection voltage Vh2 of 10 V is a median value of the data voltage range of 7.5 V to 12.5 V. In other words, if the output voltage VQ matches the detection voltage Vh2 of 10 V when BD10="1", the correct (desired) data voltage is obtained.

As illustrated in FIG. 12A, in the case of "NO" in step S8 for the preliminary setting value CSW[6:1]="1 Fh", VQ<Vh2. In this case, it is necessary to raise the output voltage VQ. From Formula FD in FIG. 7B, it can be seen that the output voltage VQ will rise if the capacitance CA of the variable capacitance circuit 30 is reduced, and thus the setting value CSW[6:1] is reduced by "1" at a time. The setting value CSW[6:1] stops at "1 Ah", where VQ≥Vh2 for the first time. Through this, the setting value CSW[6:1] at which the output voltage VQ nearest to the detection voltage Vh2 is obtained can be determined.

As illustrated in FIG. 12B, in the case of "YES" in step S8 for the preliminary setting value CSW[6:1]="1 Fh", VQ≥Vh2. In this case, it is necessary to lower the output voltage VQ. From Formula FD in FIG. 7B, it can be seen that the output voltage VQ will drop if the capacitance CA of the variable capacitance circuit 30 is increased, and thus the setting value CSW[6:1] is increased by "1" at a time. The setting value CSW[6:1] stops at "24 h", where VQ<Vh2 for the first time. Through this, the setting value CSW[6:1] at which the output voltage VQ nearest to the detection voltage Vh2 is obtained can be determined.

The setting value CSW[6:1] obtained through the above processing is determined as the final setting value CSW[6:1], and that setting value CSW[6:1] is written into the register unit 48. When driving the electro-optical panel 200 through capacitive driving, the capacitance of the variable capacitance circuit 30 is set using the setting value CSW[6:1] stored in the register unit 48.

Although this embodiment describes an example in which the setting value CSW[6:1] of the variable capacitance circuit 30 is stored in the register unit 48, the invention is not limited thereto. For example, the setting value CSW[6:1] may be stored in a memory such as a RAM or the like, or the setting value CSW[6:1] may be set using a fuse (for example, setting the setting value through cutting by a laser or the like during manufacture).

According to the detailed configuration example described above, the detection circuit 50 carries out the second detection, which detects the voltage VQ at the data voltage output terminal TVQ in the case where the capacitance CA of the variable capacitance circuit 30 is set to various setting values. The capacitance CA of the variable capacitance circuit 30 is then set based on a detection result of the second detection.

As can be seen from Formula FD in FIG. 7B, the voltage VQ outputted to the data voltage output terminal TVQ in correspondence with the tone data varies according to the capacitance CA of the variable capacitance circuit 30. In other words, when the capacitance CA of the variable capacitance circuit 30 is set to a given setting value, a voltage VQ according to that setting value will be outputted. Of the voltages VQ at these setting values, detecting the voltage VQ that matches (or is immediately nearby) a desired data voltage makes it possible to determine the setting value for the capacitance CA at which the desired data voltage corresponding to the tone data is obtained.

In addition, in this embodiment, the driver 100 includes the control circuit 40 that outputs second detection data BD[10:1] to the capacitor driving circuit 20 instead of the tone data GD [10:1] in the case where the second detection is carried out. The control circuit 40 then sets the capacitance CA of the variable capacitance circuit 30 based on the result of detecting the voltage VQ at the data voltage output terminal TVQ corresponding to the second detection data BD[10:1].

By doing so, the second detection data BD[10:1] is outputted to the capacitor driving circuit 20, which makes it possible to output a data voltage corresponding to the second detection data BD[10:1] to the data voltage output terminal TVQ. This data voltage changes in accordance with the capacitance CA of the variable capacitance circuit 30, and thus the setting value of the capacitance CA at which the desired data voltage is obtained can be determined. For example, in the example illustrated in FIG. 12A, the detection data BD[10:1] is "200 h" and the desired data voltage corresponding thereto is 10 V. The voltage VQ changes as the capacitance CA of the variable capacitance circuit 30 is changed, and the setting value of the capacitance CA when the voltage VQ is immediately nearby (immediately above or below) the desired data voltage of 10 V is ultimately employed as the setting value. In this manner, the capacitance CA of the variable capacitance circuit 30 can be determined by detecting the voltage VQ.

In addition, in this embodiment, the ith capacitor Ci of the first to tenth capacitors C1 to C10 has a capacitance value weighted by 2 to the power of (i−1). The control circuit 40 outputs the second detection data BD[10:1] that causes the tenth capacitor driving voltage, of the first to tenth capacitor driving voltages, to switch from the first voltage level (0 V) to the second voltage level (15 V), which is higher than the first voltage level. Then, for each setting value for the capacitance CA of the variable capacitance circuit 30, the detection circuit 50 detects whether or not the voltage VQ at the data voltage output terminal TVQ exceeds the prescribed voltage (10 V) in the case where the tenth capacitor driving voltage has been switched from the first voltage level (0 V) to the second voltage level (15 V).

Accordingly, the tenth capacitor driving voltage is switched from 0 V to 15 V when the capacitance CA of the variable capacitance circuit 30 is set to each setting value. This corresponds to switching the bit BD10 in the detection data BD[10:1] from "0" to "1" in the flow illustrated in FIG. 11. The capacitance CA of the variable capacitance circuit 30 can be determined by detecting whether or not the voltage VQ exceeds the prescribed voltage (the detection voltage Vh2 of 10 V) when this switch is carried out. In other words, as described with reference to FIGS. 12A and 12B, there are setting values where the voltage VQ does and does not exceed 10 V when the switch is carried out, and thus employing a border between those two scenarios as the setting value makes it possible to determine the setting value for the capacitance CA.

In addition, in this embodiment, the electro-optical panel 200 is driven (capacitive driving) by the capacitor driving circuit 20 and the capacitor circuit 10 under the condition that it has been determined, based on the detection result from the detection circuit 50, that the voltage VQ at the data voltage output terminal TVQ does not exceed the breakdown voltage of the driver 100.

In addition, in this embodiment, the electro-optical panel 200 is driven (capacitive driving) by the capacitor driving circuit 20 and the capacitor circuit 10 under the condition that it has been determined, based on the detection result from the detection circuit 50, that the voltage VQ at the data voltage output terminal TVQ does not exceed the breakdown voltage of the electro-optical panel 200.

For example, in the connection state detection process (the first detection) illustrated in the flow in FIG. 9, it is detected whether or not the breakdown voltage of the driver 100 has been determined not to be exceeded. In other words, whether or not the breakdown voltage of the driver 100 will be exceeded when capacitive driving is carried out is indirectly detected by detecting the connection state of the electro-optical panel 200.

Alternatively, in the process for determining the capacitance CA of the variable capacitance circuit 30 (the second detection) illustrated in the flow in FIG. 11, it is detected whether or not the breakdown voltages of the driver 100 and the electro-optical panel 200 have been determined not to be exceeded. Although the capacitance CA at which the desired data voltage is obtained is determined in the second detection, this means that the data voltage range is an appropriate range (that does not exceed the power source voltage). In other words, whether or not the breakdown voltages of the driver 100 and the electro-optical panel 200 will be exceeded when capacitive driving is carried out is indirectly detected by determining the capacitance CA through the second detection. Note that the breakdown voltage of the electro-optical panel 200 is, for example, a voltage at which electrostatic breakdown will not occur in the electro-optical panel 200, a voltage at which the pixels of the electro-optical panel 200 will not experience burn-in, and so on. For example, the breakdown voltage of the electro-optical panel 200 is approximately the same as the breakdown voltage of the driver 100.

9. Phase Expansion Driving Method

Next, a method of driving the electro-optical panel 200 will be described. The following describes an example of phase expansion driving, but the method of driving carried out by the driver 100 in this embodiment is not limited to phase expansion driving.

Figure 13:
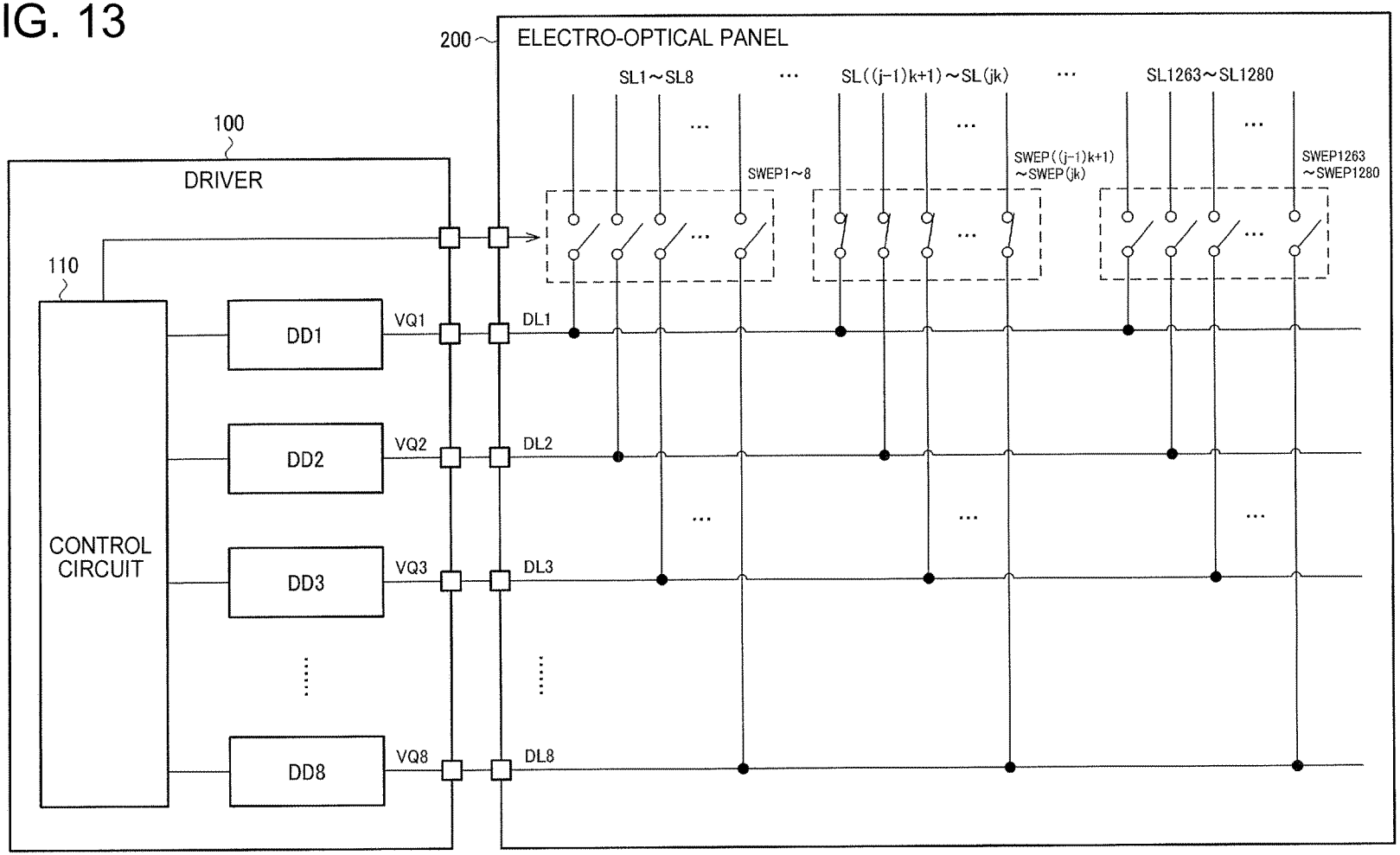
FIG. 13 illustrates a second example of the detailed configuration of a driver, an example of the detailed configuration of an electro-optical panel, and an example of the configuration of connections between the driver and the electro-optical panel.

FIG. 13 illustrates a second example of the detailed configuration of a driver, an example of the detailed configuration of an electro-optical panel, and an example of the configuration of connections between the driver and the electro-optical panel.

The driver 100 includes the control circuit 40 and first to kth data line driving circuits DD1 to DDk (where k is a natural number of 2 or more). The data line driving circuits DD1 to DDk each correspond to the data line driving circuit 110 illustrated in FIG. 8. Note that the following will describe an example in which k=8.

The control circuit 40 outputs corresponding tone data to each data line driving circuit in the data line driving circuits DD1 to DD8. The control circuit 40 also outputs a control signal (for example, ENBX illustrated in FIG. 14 or the like) to the electro-optical panel 200.

The data line driving circuits DD1 to DD8 convert the tone data into data voltages, and output those data voltages to the data lines DL1 to DL8 of the electro-optical panel 200 as output voltages VQ1 to VQ8.

The electro-optical panel 200 includes the data lines DL1 to DL8 (first to kth data lines), switching elements SWEP1 to SWEP(t×k), and source lines SL1 to SL(t×k). t is a natural number of 2 or more, and the following will describe an example in which t=160 (in other words, t×k=160×8=1,280 (WXGA)).

Of the switching elements SWEP1 to SWEP1280, one end of each of the switching elements SWEP((j−1)×k+1) to SWEP(j×k) is connected to the data lines DL1 to DL8. j is a natural number no greater than t, which is 160. For example, in the case where j=1, the switching elements are SWEP1 to SWEP8.

The switching elements SWEP1 to SWEP1280 are constituted of TFTs (Thin Film Transistors) or the like, for example, and are controlled based on control signals from the driver 100. For example, the electro-optical panel 200 includes a switching control circuit (not shown), and that switching control circuit controls the switching elements SWEP1 to SWEP1280 to turn on and off based on a control signal such as ENBX.

Figure 14:
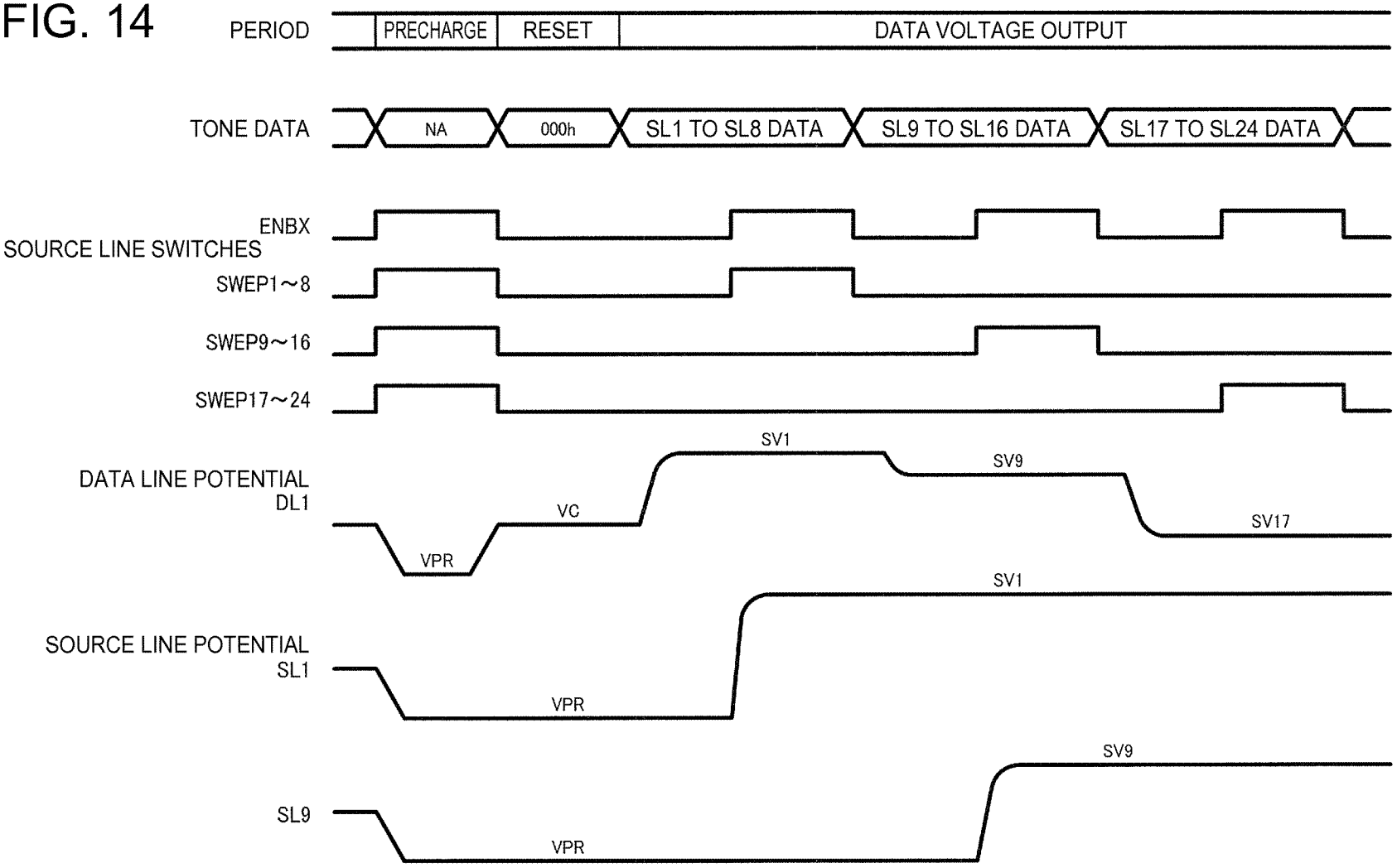
FIG. 14 is an operational timing chart of a driver and an electro-optical panel.

FIG. 14 is an operational timing chart of the driver 100 and the electro-optical panel 200 illustrated in FIG. 13.

In a precharge period, the signal ENBX goes to high-level, and all of the switching elements SWEP1 to SWEP1280 turn on. Then, all of the source lines SL1 to SL1280 are set to a precharge voltage VPR. For example, the driver 100 includes a precharge amplifier circuit, and the precharge amplifier circuit outputs the precharge voltage VPR.

In a reset period, the signal ENBX goes to low-level, and the switching elements SWEP1 to SWEP1280 all turn off. The data lines DL1 to DL8 are then set to the reset voltage VC of 7.5 V. The source lines SL1 to SL1280 remain at the precharge voltage VPR.

In a first output period in a data voltage output period, the tone data corresponding to the source lines SL1 to SL8 are inputted into the data line driving circuits DD1 to DD8. Then, capacitive driving is carried out by the capacitor circuit 10 and the capacitor driving circuit 20, and the data lines DL1 to DL8 are driven by data voltages SV1 to SV8. After the capacitive driving starts, the signal ENBX goes to high-level, and the switching elements SWEP1 to SWEP8 turn on. Then, the source lines SL1 to SL8 are driven by the data voltages SV1 to SV8. At this time, a single gate line (horizontal scanning line) is selected by a gate driver (not shown), and the data voltages SV1 to SV8 are written into the pixel circuits connected to the selected gate line and the data lines DL1 to DL8. Note that FIG. 14 illustrates potentials of the data line DL1 and the source line SL1 as examples.

In a second output period, the tone data corresponding to the source lines SL9 to SL16 are inputted into the data line driving circuits DD1 to DD8. Then, capacitive driving is carried out by the capacitor circuit 10 and the capacitor driving circuit 20, and the data lines DL1 to DL8 are driven by data voltages SV9 to SV16. After the capacitive driving starts, the signal ENBX goes to high-level, and the switching elements SWEP9 to SWEP16 turn on. Then, the source lines SL9 to SL16 are driven by the data voltages SV9 to SV16. At this time, the data voltages SV9 to SV16 are written into the pixel circuits connected to the selected gate line and the data lines DL9 to DL16. Note that FIG. 14 illustrates potentials of the data line DL1 and the source line SL9 as examples.

Thereafter, the source lines SL17 to SL24, SL25 to SL32, . . . , and SL1263 to SL1280 are driven in the same manner in a third output period, a fourth output period, . . . , and a 160th output period, after which the process moves to a postcharge period.

10. Electronic Device

Figure 15:
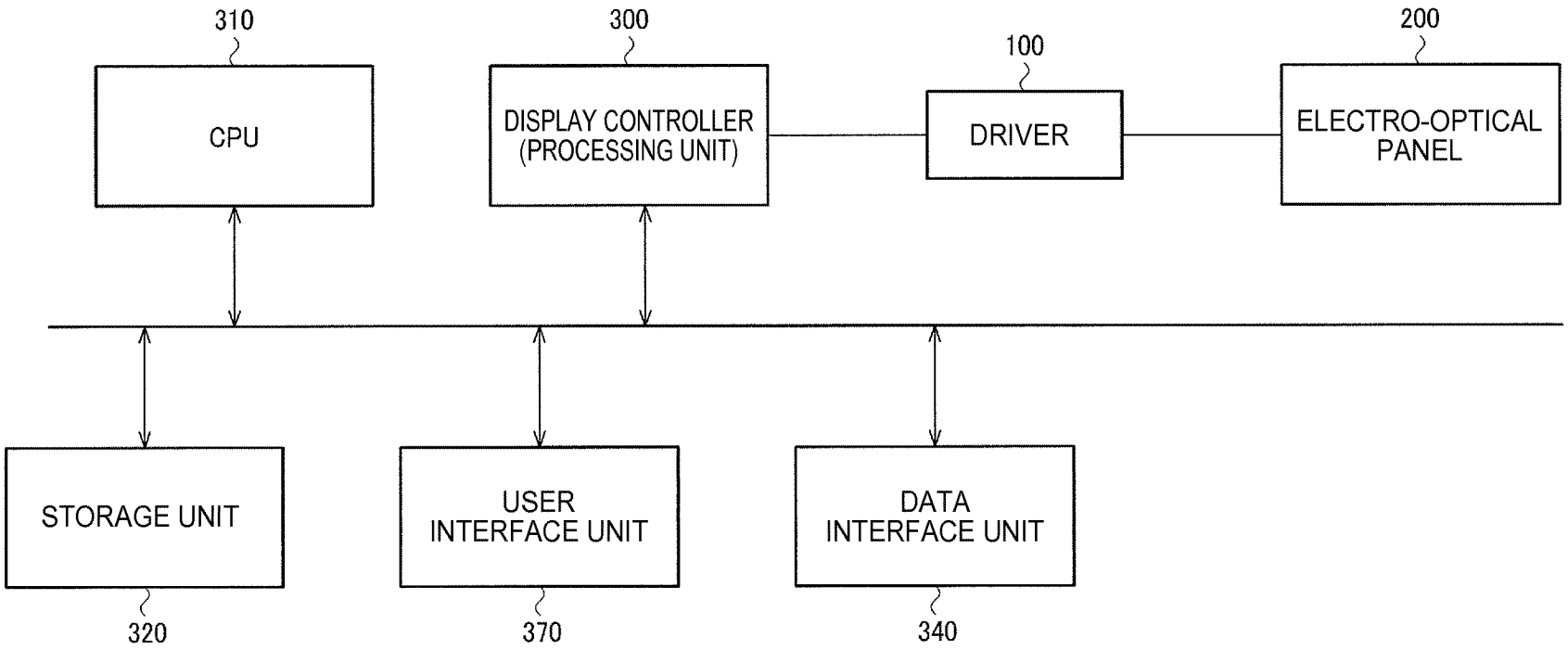
FIG. 15 illustrates an example of the configuration of an electronic device.

FIG. 15 illustrates an example of the configuration of an electronic device in which the driver 100 according to this embodiment can be applied. A variety of electronic devices provided with display devices can be considered as the electronic device according to this embodiment, including projector, a television device, an information processing apparatus (a computer), a mobile information terminal, a car navigation system, a mobile gaming terminal, and so on, for example.

The electronic device illustrated in FIG. 15 includes the driver 100, the electro-optical panel 200, the display controller 300 (a first processing unit), a CPU 310 (a second processing unit), a storage unit 320, a user interface unit 330, and a data interface unit 340.

The electro-optical panel 200 is a matrix-type liquid-crystal display panel, for example. Alternatively, the electro-optical panel 200 may be an EL (Electro-Luminescence) display panel using selfluminous elements. The user interface unit 330 is an interface unit that accepts various operations from a user. The user interface unit 330 is constituted of buttons, a mouse, a keyboard, a touch panel with which the electro-optical panel 200 is equipped, or the like, for example. The data interface unit 340 is an interface unit that inputs and outputs image data, control data, and the like. For example, the data interface unit 340 is a wired communication interface such as USB, a wireless communication interface such as a wireless LAN, or the like. The storage unit 320 stores image data inputted from the data interface unit 340. Alternatively, the storage unit 320 functions as a working memory for the CPU 310, the display controller 300, or the like. The CPU 310 carries out control processing for the various units in the electronic device, various types of data processing, and so on. The display controller 300 carries out control processing for the driver 100. For example, the display controller 300 converts image data transferred from the data interface unit 340, the storage unit 320, or the like into a format that can be handled by the driver 100, and outputs the converted image data to the driver 100. The driver 100 drives the electro-optical panel 200 based on the image data transferred from the display controller 300.

Although the foregoing has described embodiments of the invention in detail, one skilled in the art will easily recognize that many variations can be made thereon without departing from the essential spirit of the novel items and effects of the invention. Such variations should therefore be taken as being included within the scope of the invention. For example, in the specification or drawings, terms denoted at least once along with terms that have broader or the same definitions as those terms ("low-level" and "high-level" for "first logic level" and "second logic level", respectively) can be replaced with those terms in all areas of the specification or drawings. Furthermore, all combinations of the embodiments and variations fall within the scope of the invention. Finally, the configurations and operations of the capacitor circuit, capacitor driving circuit, variable capacitance circuit, detection circuit, control circuit, driver, electro-optical panel, electronic device are not limited to those described in the embodiments, and many variations can be made thereon.

The entire disclosure of Japanese Patent Application No. 2014-210366, filed Oct. 15, 2014 is expressly incorporated by reference herein.

What is claimed is:

1. A driver comprising:

a control circuit that outputs detection data or image data to a capacitor driving circuit, the capacitor driving circuit outputting first to nth capacitor driving voltages where n is a natural number of 2 or more, corresponding to the image data to first to nth capacitor driving nodes;

a capacitor circuit including first to nth capacitors provided between the first to nth capacitor driving nodes and a data voltage output terminal;

a detection circuit that carries out a detection that detects a connection state between the data voltage output terminal and an electro-optical panel during a time when the control circuit outputs the detection data, wherein the detection circuit is a circuit that detects a voltage at the data voltage output terminal; and wherein the control circuit determines the connection state based on a result of detecting a voltage provided by the detection circuit, corresponding to the detection data, at the data voltage output terminal.

2. The driver according to claim 1, wherein an ith capacitor of the first to nth capacitors has a capacitance value weighted by 2 to the power of (i−1) where i is a natural number no greater than n;

the capacitor driving circuit outputs a first voltage level or a second voltage level that is higher than the first voltage level as each of the first to nth capacitor driving voltages; and the control circuit outputs the first detection data that sequentially increases a total capacitance of the capacitors, among the first to nth capacitors, to which the second voltage level is supplied.

3. The driver according to claim 1, further comprising:

a register unit into which a result of detecting the connection state can be written, and from which the result of detecting the connection state can be read out by an external processing unit.

4. The driver according to claim 1, wherein the electro-optical panel is driven by the capacitor driving circuit and the capacitor circuit under a condition that it has been determined, based on the detection result from the detection circuit, that the voltage at the data voltage output terminal does not exceed a breakdown voltage of the driver.

5. The driver according to claim 1, wherein the electro-optical panel is driven by the capacitor driving circuit and the capacitor circuit under a condition that it has been determined, based on the detection result from the detection circuit, that the voltage at the data voltage output terminal does not exceed a breakdown voltage of the electro-optical panel.

6. A driver comprising:

a control circuit that outputs detection data or image data to a capacitor driving circuit, the capacitor driving circuit outputting first to nth capacitor driving voltages, where n is a natural number of 2 or more, corresponding to image data to first to nth capacitor driving nodes;

a capacitor circuit including first to nth capacitors provided between the first to nth capacitor driving nodes and a data voltage output terminal, wherein the electro-optical panel is driven by the capacitor driving circuit and the capacitor circuit under a condition that it has been determined that a voltage at the data voltage output terminal does not exceed a breakdown voltage of the driver or a breakdown voltage of an electro-optical panel;

a detection circuit that carries out a detection that detects a connection state between the data voltage output terminal and the electro-optical panel during a time when the control circuit outputs the detection data and that detects a voltage at the data voltage output terminal; and wherein the control circuit determines the connection state based on a result of detecting a voltage provided by the detection circuit, corresponding to the detection data, at the data voltage output terminal.

7. An electronic device comprising the driver according to claim 1.

8. An electronic device comprising the driver according to claim 2.

9. An electronic device comprising the driver according to claim 3.

* * * * *